US008307572B2

(12) United States Patent
Foxen et al.

(10) Patent No.: US 8,307,572 B2
(45) Date of Patent: Nov. 13, 2012

(54) PROTECTIVE BOOT

(75) Inventors: Thomas Foxen, Portland, OR (US); John Hurd, Tigard, OR (US); Mike Jones, Portland, OH (US); Anthony Hope, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 552 days.

(21) Appl. No.: 12/563,751

(22) Filed: Sep. 21, 2009

(65) Prior Publication Data

US 2011/0067271 A1 Mar. 24, 2011

(51) Int. Cl.
*A43B 5/14* (2006.01)
*A43B 23/08* (2006.01)
*A43B 13/14* (2006.01)

(52) U.S. Cl. ..... 36/131; 36/72 R; 36/89; 36/109; 36/77 R; 36/25 R

(58) Field of Classification Search ..... 36/131, 36/72 R, 89, 109, 77 R, 25 R, 117.2–118.8, 36/103, 107, 92, 30 R, 28
See application file for complete search history.

(56) References Cited

U.S. PATENT DOCUMENTS

| | | | | |
|---|---|---|---|---|
| 1,205,206 | A | 11/1916 | Hofmeister | |
| 3,410,006 | A | 11/1968 | Vogel | |
| 4,184,273 | A | 1/1980 | Boyer et al. | |
| 4,268,981 | A * | 5/1981 | Olivieri | 36/115 |
| 4,289,122 | A | 9/1981 | Mason et al. | |
| 4,308,674 | A * | 1/1982 | Tessaro | 36/118.9 |
| 4,387,517 | A * | 6/1983 | Annovi | 36/118.2 |
| 4,467,538 | A * | 8/1984 | Olivieri | 36/117.1 |
| 4,587,749 | A | 5/1986 | Berlese | |
| 4,611,415 | A * | 9/1986 | Tonel | 36/115 |
| 4,640,027 | A | 2/1987 | Berlese | |
| 4,685,226 | A * | 8/1987 | Olivieri et al. | 36/118.7 |
| 4,882,858 | A | 11/1989 | Signori | |
| 4,955,149 | A | 9/1990 | Ottieri | |
| 5,044,360 | A | 9/1991 | Janke | |

(Continued)

FOREIGN PATENT DOCUMENTS

EP 0769258 4/1997

(Continued)

OTHER PUBLICATIONS

International Search Report and Written Opinion mailed May 25, 2011 in International Application No. PCT/US2010/049481.

*Primary Examiner* — Ted Kavanaugh
(74) *Attorney, Agent, or Firm* — Plumsea Law Group, LLC

(57) ABSTRACT

An article of footwear has an upper and a sole structure. The upper has a foot portion for receiving a foot and a leg portion for receiving at least a portion of a leg, and the sole structure is secured to a lower area of the foot portion. The footwear includes at least one of a plate system, a hinge system, and a sole structure formed from materials of different hardness, stiffness, or density. The plate system includes a plate that extends over a medial side of the footwear and may (a) be formed of materials of different hardness or (b) extend onto the sole structure and into an indentation in the sole structure. The hinge system includes a chassis secured to the foot portion and a beam secured to the leg portion, with a hinge rotatably-joining the chassis and beam.

38 Claims, 25 Drawing Sheets

U.S. PATENT DOCUMENTS

| | | | | | |
|---|---|---|---|---|---|
| 5,056,509 | A | | 10/1991 | Swearington | |
| 5,074,060 | A | * | 12/1991 | Brncick et al. | 36/77 R |
| 5,086,575 | A | * | 2/1992 | Bonaventure | 36/117.3 |
| 5,090,138 | A | | 2/1992 | Borden | |
| 5,142,798 | A | * | 9/1992 | Kaufman et al. | 36/117.4 |
| 5,212,893 | A | * | 5/1993 | Pozzobon | 36/118.8 |
| 5,526,586 | A | * | 6/1996 | Foscaro | 36/117.1 |
| 5,623,773 | A | * | 4/1997 | Bergamin | 36/117.1 |
| 5,664,344 | A | * | 9/1997 | Marmonier | 36/118.2 |
| 5,716,336 | A | | 2/1998 | Hines et al. | |
| 5,732,483 | A | * | 3/1998 | Cagliari | 36/115 |
| 5,815,952 | A | | 10/1998 | Bobrowicz | |
| 5,865,778 | A | * | 2/1999 | Johnson | 602/27 |
| 5,937,546 | A | | 8/1999 | Messmer | |
| 6,233,848 | B1 | * | 5/2001 | Bonaventure | 36/89 |
| 6,409,695 | B1 | | 6/2002 | Connelly | |
| 6,779,283 | B2 | | 8/2004 | Gabrielli | |
| 6,883,256 | B2 | | 4/2005 | Mazzarolo | |
| 6,981,340 | B2 | | 1/2006 | Evans | |
| 7,257,908 | B2 | | 8/2007 | Valat et al. | |
| 7,426,792 | B2 | * | 9/2008 | Swigart et al. | 36/28 |
| 7,430,818 | B2 | | 10/2008 | Valat et al. | |
| 7,530,182 | B2 | | 5/2009 | Munns | |
| 7,530,183 | B2 | | 5/2009 | Munns | |
| 2002/0029009 | A1 | | 3/2002 | Bowman | |
| 2002/0083617 | A1 | * | 7/2002 | Tsou et al. | 36/8.4 |
| 2003/0158506 | A1 | | 8/2003 | Hinshon | |
| 2005/0126044 | A1 | | 6/2005 | Langley | |
| 2005/0223599 | A1 | | 10/2005 | Valat et al. | |
| 2006/0101672 | A1 | | 5/2006 | Valat et al. | |
| 2009/0216167 | A1 | | 8/2009 | Harris | |
| 2009/0260259 | A1 | | 10/2009 | Berend | |

FOREIGN PATENT DOCUMENTS

| | | |
|---|---|---|
| FR | 2221093 | 10/1974 |
| WO | 0010415 | 3/2000 |
| WO | 02052969 | 7/2002 |
| WO | 02053242 | 7/2002 |

* cited by examiner

PROTECTIVE BOOT

BACKGROUND

Competitive motorcycle riders may engage in a variety of motorcycle sports, including track racing, road rally racing, land speed trials, enduro, freestyle motocross, and observed trials, for example. During any of these motorcycle sports, as well as practice or training sessions, riders face various hazards stemming from impacts with obstacles and the ground, as well as contact with the rider's motorcycle and other motorcycles or vehicles. Non-competitive motorcycle riders may face similar dangers while commuting, traveling, or sightseeing. In order to guard against these hazards or dangers, motorcycle riders often wear protective apparel, including helmets, braces, shirts and pants that incorporate pads or plates, gloves, and boots.

Each of the various types of protective apparel noted above are designed to incorporate features that offer protection to the rider. As an example, boots worn during motorcycle sports often include various pads and rigid structures (e.g., braces and plates) that protect the foot and lower leg from impact or twisting forces. Such boots may also incorporate a durable sole that resists wear from contact with the ground or areas of the motorcycle. Moreover, these boots may integrate a steel toe guard that prevents delamination in forefoot areas of the boot, as well as deformation or crumpling.

SUMMARY

An article of footwear having a configuration of a boot is disclosed below. The footwear includes an upper and a sole structure. The upper has a foot portion for receiving a foot of a wearer and a leg portion for receiving at least a portion of a leg of the wearer, and the sole structure is secured to a lower area of the foot portion. Although the configuration of the footwear may vary significantly, the footwear includes at least one of a plate system, a hinge system, and a sole structure formed from materials of different hardness, stiffness, or density.

The plate system may include a plate that extends over a medial side of the leg portion and a medial side of the foot portion of the upper, and may extend into an indentation of the sole structure, thereby covering a portion of the sole structure. In some configurations, the plate system includes an overlay formed from rubber or another material that is softer than a material of the plate, and the overlay forms the exterior surface of the upper in the area of the plate.

The hinge system may include a chassis, a beam, and a hinge. The chassis is secured to the foot portion and is located on a lateral side of the upper. In some configurations, the chassis also extends under or adjacent to a lower area of the foot portion. The beam extends adjacent to a lateral side of the leg portion, and the hinge joins the chassis with the beam. The hinge may permit rotational movement between the beam and the chassis in a forward-rearward direction, but may also restrict rotational movement between the beam and the chassis in a medial-lateral direction (i.e., inversion and eversion).

The sole structure may include first and second sole sections. The first sole section extends from a heel region of the footwear to at least a midfoot region of the footwear and is formed from a material with a first hardness. The second sole section is located in at least a forefoot region of the footwear, and is formed from a material with a second hardness, the first hardness being less than the second hardness. In some configurations, the second sole section includes a flange that extends onto a lateral side and a medial side of the upper in at least the forefoot region.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

Figure 24:
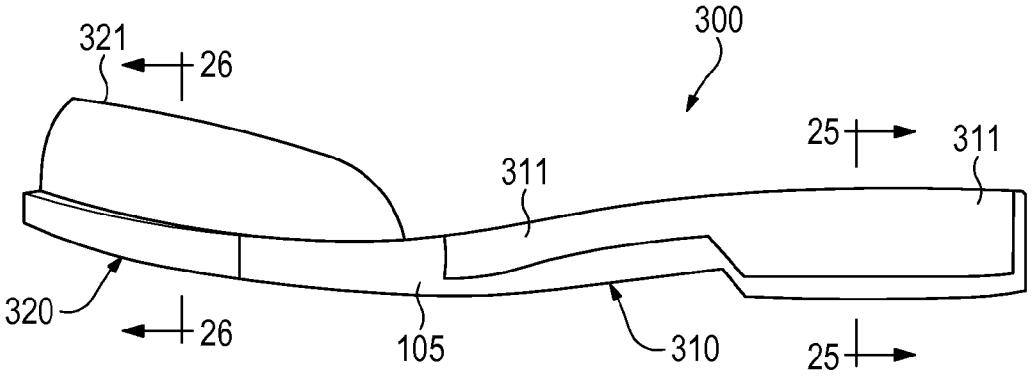
FIG. 24 is a medial side elevational view of the sole structure.
Figure 25:
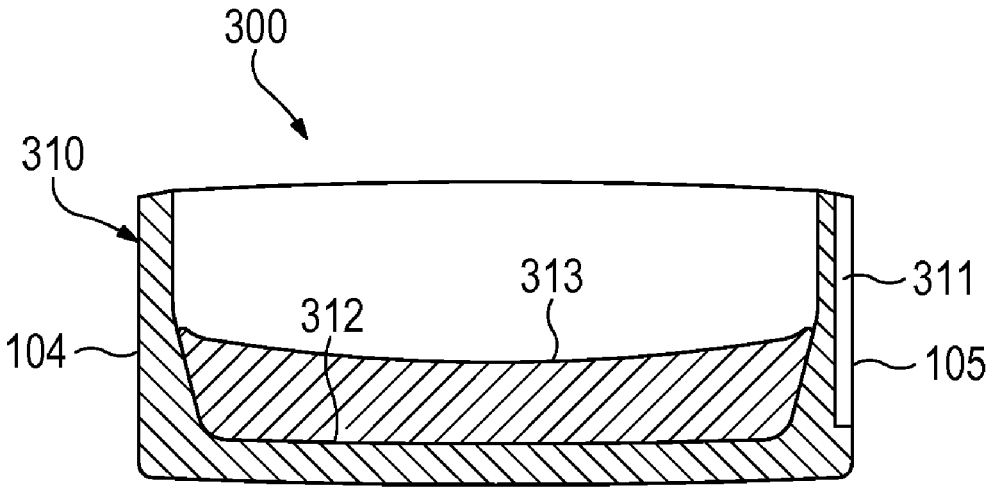
Figure 26:
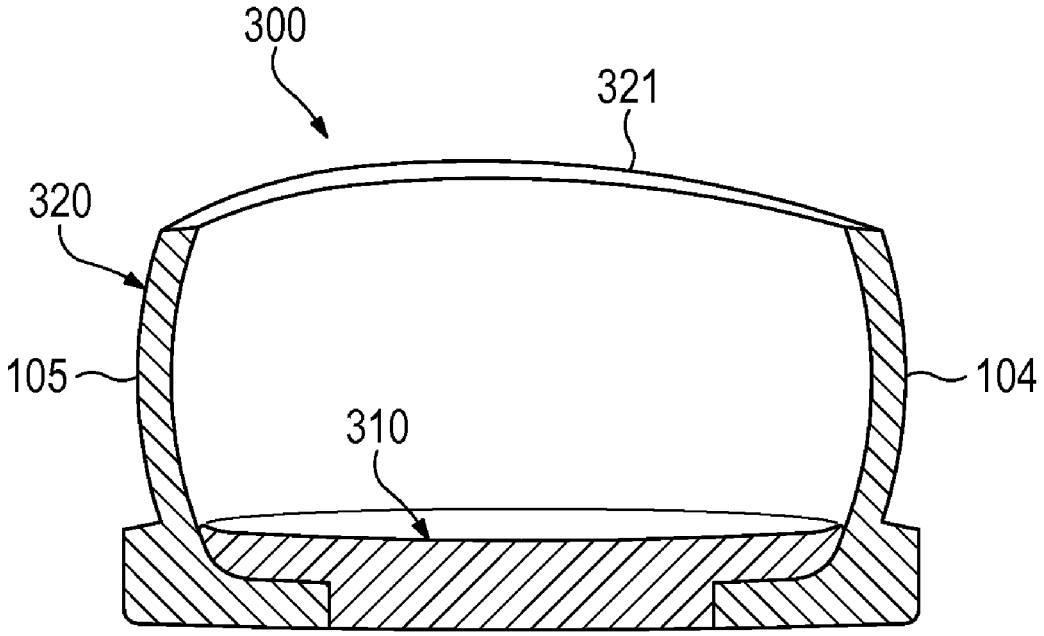

FIGS. 25 and 26 are cross-sectional views of the sole structure, as defined by section lines 25 and 26 in FIG. 24.

Figure 27:
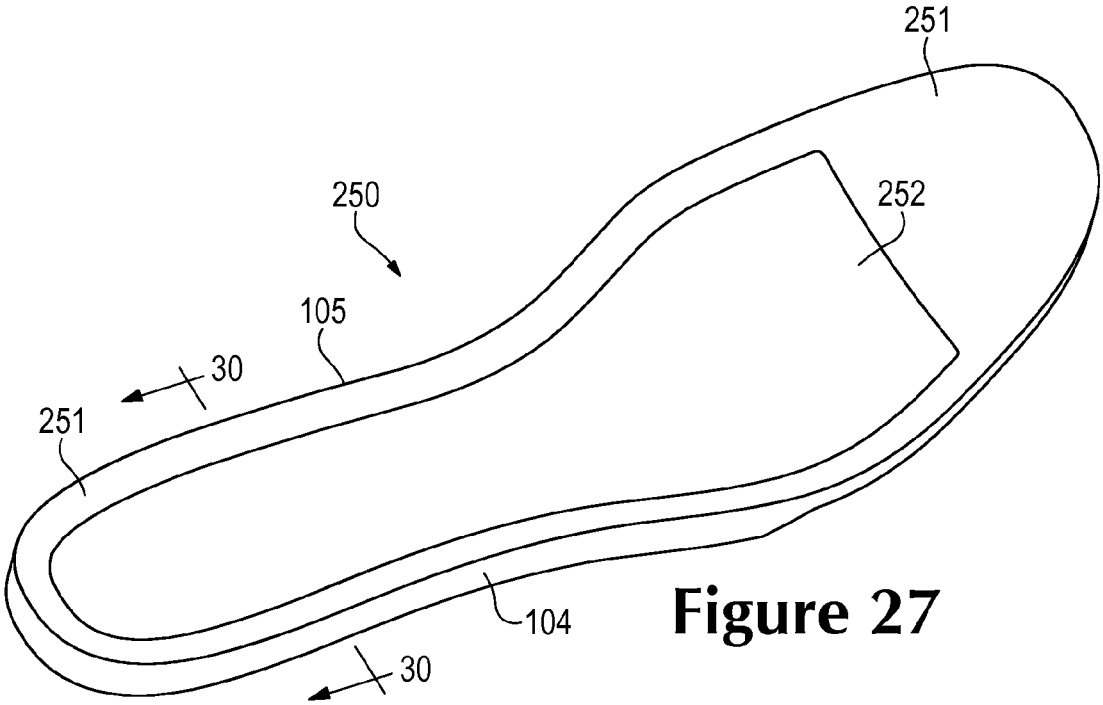
Figure 28:
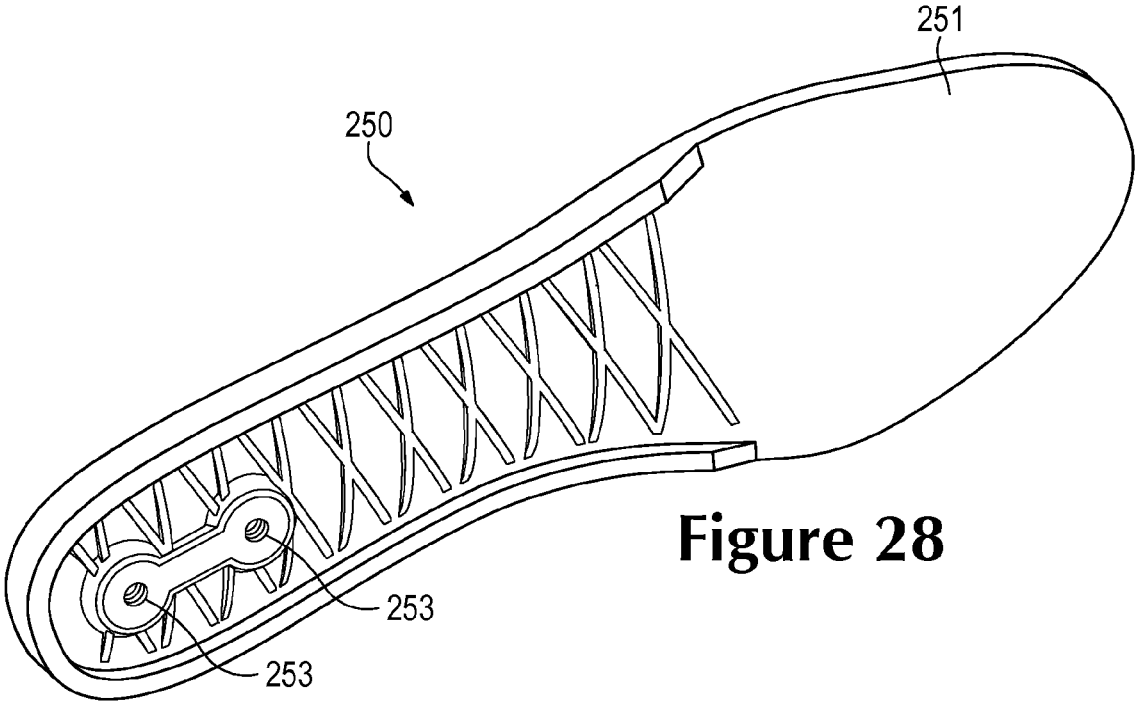

FIGS. 27 and 28 are perspective views of a lasting board of the boot.

Figure 29:
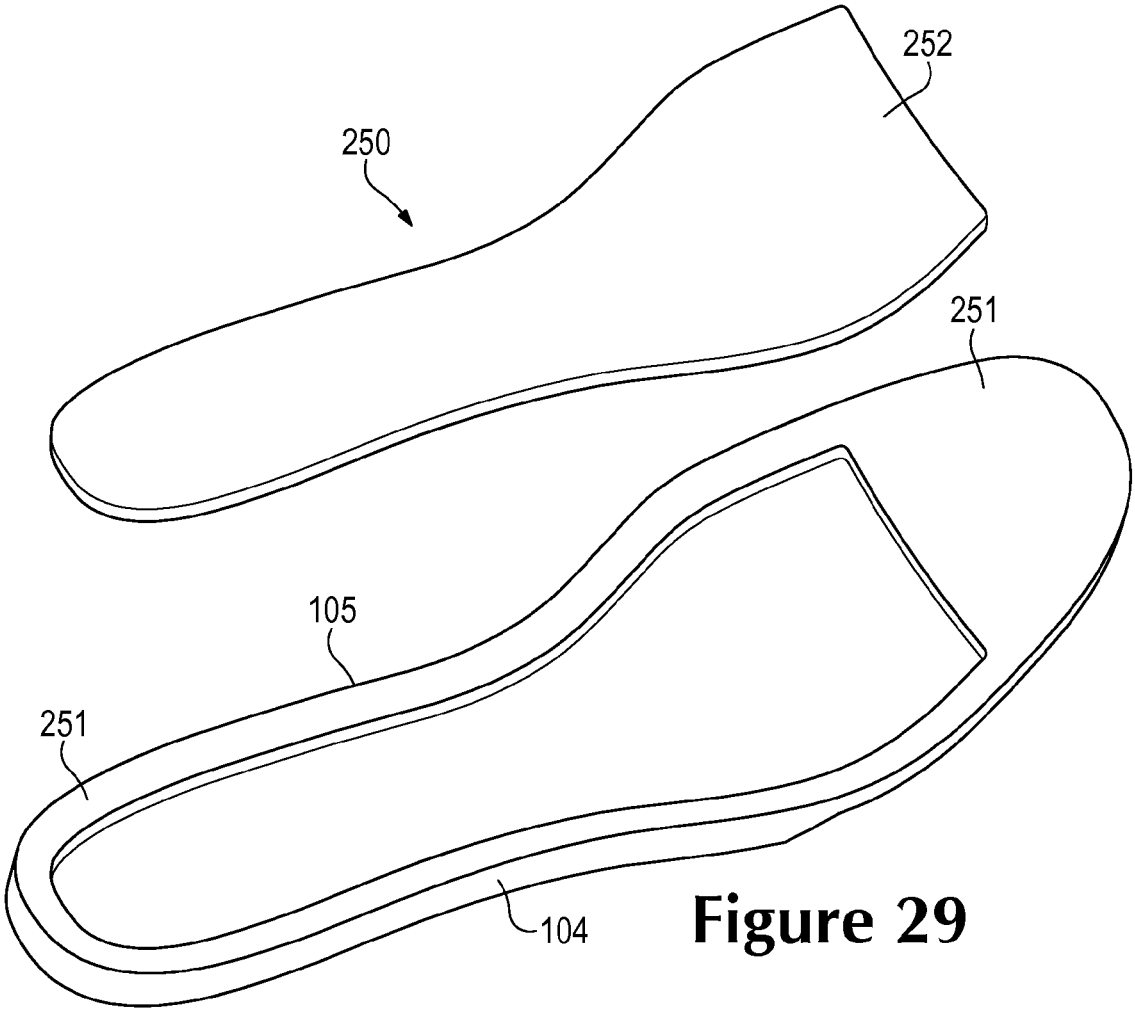

FIG. 29 is an exploded perspective view of the lasting board.

Figure 30:
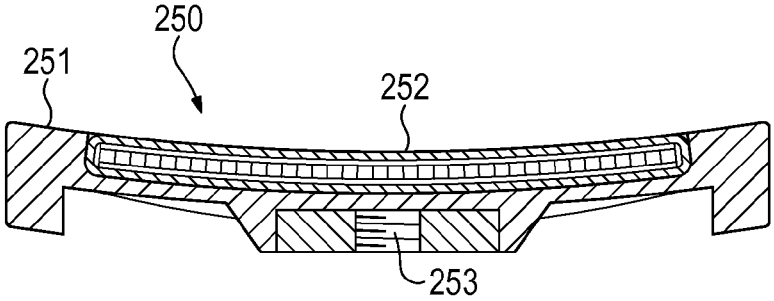

FIG. 30 is a cross-sectional view of the lasting board, as defined by section line 30 in FIG. 27.

DETAILED DESCRIPTION

The following discussion and accompanying figures disclose an article of footwear, specifically a protective boot. Concepts related to the protective boot are discussed with reference to motorcycle sports, which include track racing, road rally racing, land speed trials, enduro, freestyle motocross, and observed trials, for example. Concepts associated with the protective boot are not limited to boot configurations utilized for motorcycle sports, however, and may be incorporated into a wide range of boot configurations for non-competitive motorcycle riders (i.e., for commuting, traveling, or sightseeing), as well as boot configurations utilized for other activities (e.g., equestrian, snowboarding, wake boarding, biking). The concepts disclosed herein may, therefore, apply to articles of footwear utilized for a wide variety of motorcycle activities and other activities.

General Footwear Structure

A protective boot 100 is depicted in FIGS. 1-7 as including an upper 200 and a sole structure 300. For reference purposes, boot 100 may be divided into three general regions: a forefoot region 101, a midfoot region 102, and a heel region 103. Boot 100 also includes a lateral side 104 and a medial side 105. Forefoot region 101 generally includes portions of boot 100 corresponding with forward areas of the foot, including the toes and the joints connecting the metatarsals with the phalanges. Midfoot region 102 generally includes portions of boot 100 corresponding with the arch area of the foot, as well as forward areas of the ankle and lower leg. Heel region 103 corresponds with rear portions of the foot, including the calcaneus bone, as well as rearward areas of the ankle and lower leg. Lateral side 104 and medial side 105 extend through each of regions 101-103 and correspond with opposite sides of boot 100. Regions 101-103 and sides 104-105 are not intended to demarcate precise areas of boot 100. Rather, regions 101-103 and sides 104-105 are intended to represent general areas of boot 100 to aid in the following discussion. In addition to boot 100, regions 101-103 and sides 104-105 may also be applied to upper 200, sole structure 300, and individual elements thereof.

Upper 200 is generally constructed to form a secure, comfortable, and protective structure that receives a foot and a portion of a leg (i.e., the lower leg) of the wearer. A majority of upper 200 is formed from a plurality material elements (e.g., textiles, foam, polymer sheets and plates, leather, or synthetic leather) that are stitched or bonded together to define an interior void in which the foot and leg are located, thereby forming a structure for extending around the foot and leg. The various material elements forming upper 200 may be selected and located to impart properties of durability, air-permeability, wear-resistance, flexibility, and comfort, for example, to specific areas of upper 200. Moreover, the material elements may attenuate impact forces upon the foot and leg, insulate the foot and leg from heat (e.g., from a motorcycle engine or exhaust system), and prevent twisting of the foot and leg, for example.

General areas of upper 200 include a foot portion 201 and a leg portion 202. Foot portion 201 forms an area of the void for receiving the foot, and leg portion 202 forms an area of the void for receiving the leg. In order to securely position the foot and leg, upper 200 includes two forward flaps 203 that wrap around a front area of leg portion 202 from medial side 105 to lateral side 104, and upper 200 includes two rearward flaps 204 that wrap around a rear area of leg portion 202 from medial side 105 to lateral side 104. A pair of buckles 205 are secured to flaps 203 and 204 and are utilized to tighten upper 200 around the leg and foot, thereby securing the leg and foot within the void in upper 200. Another forward flap 203 wraps around the interface between portions 201 and 202 and joins with a buckle 205 that is secured to foot portion 201 on lateral side 104. Buckles 205 may also be loosened to permit entry and removal of the leg and foot from the void in upper 200. As depicted, two of forward flaps 203 may be joined as a single element that wraps around a front area of leg portion 202 to effectively form a shin guard. Similarly, rearward flaps 204 may be joined as a single element that wraps around a rear area of leg portion 202 to effectively form a calf guard. In order to impart further protection to the leg, padding, plates, or other protective features may be incorporated into the shin guard and calf guard formed by forward flaps 203 and rearward flaps 204. Additionally, a heel counter 206 may be secured to foot portion 201 in heel region 103 in order to limit movement of the heel.

As discussed in greater detail below, upper 200 incorporates a plate system and a hinged system that impart further advantages to boot 100. The plate system protects the foot and leg and also imparts grip upon a motorcycle during motorcycle sports. More particularly, a plate 210 is located on medial side 105 and extends throughout a majority of a height of boot 100. Whereas a back plate 211 is secured to upper 200 and formed from a relatively rigid or semi-rigid material to impart protection, an overlay 212 forms an exterior surface of plate 210 and is formed from a softer material that assists with gripping the motorcycle. The hinged system provides underfoot support, linear and lateral support, and impact protection. Moreover, the hinged system restricts movement of the foot and leg about the ankle joint to prevent twisting. In the hinged system, a chassis 220 is located adjacent to foot portion 201 and a beam 230 is located adjacent to leg portion 202 on lateral side 104. A hinge 240 joins chassis 220 with beam 230 and allows leg portion 202 to rotate relative to foot portion 201 in a forward-rearward direction, while restricting movement in other directions (i.e., restricting inversion and eversion).

Sole structure 300 is secured to upper 200 and has a configuration that extends between upper 200 and the ground. In general, the various elements of sole structure 300 may attenuate forces (i.e., provide cushioning), impart traction during walking and running, as well as with various areas of a motorcycle (i.e., foot peg, brake, gear shifter), and offer protection to the foot. As discussed in greater detail below, sole structure 300 includes a rearward sole section 310 and a forward sole section 320. Rearward sole section 310 extends from heel region 103 to at least midfoot region 102, and forward sole section 320 is located in at least forefoot region 101. Sole sections 310 and 320 are formed from materials with different hardnesses. More particularly, forward sole section 320 may be formed from a harder, denser, or less flexible material than rearward sole section 310 to impart protection to the foot in forefoot region 101. Additionally, forward sole section 320 includes a flange 321 that extends onto upper 200 in forefoot region 101 to offer further protection to the foot without the need for steel toe guards. In some configurations, sole sections 310 and 320 may be joined with both a mechanical interlock and a bonded interlock.

Plate System Configuration

Figure 8:
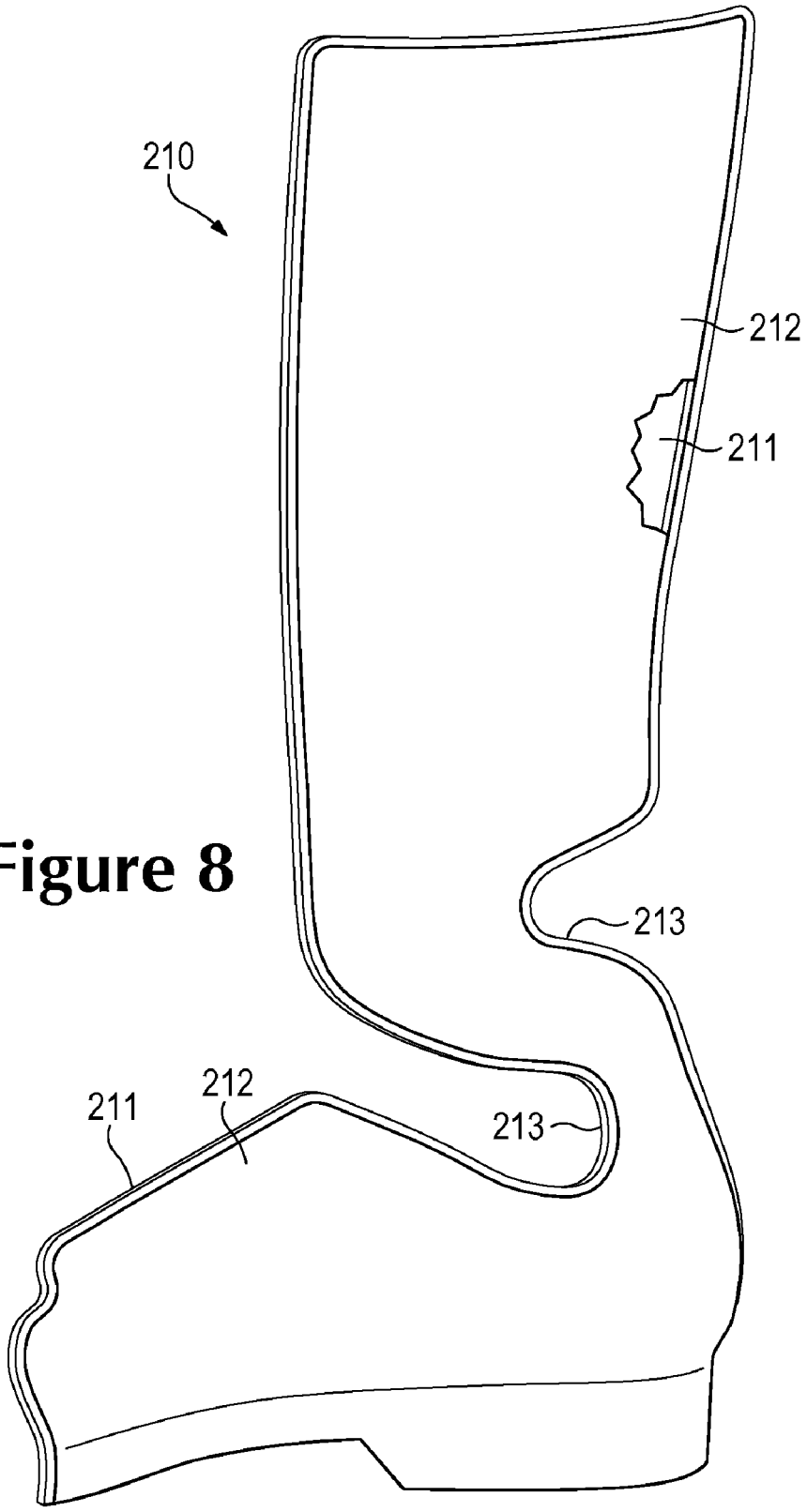
FIG. 8 is a perspective view of a plate of the boot.
Figure 9:
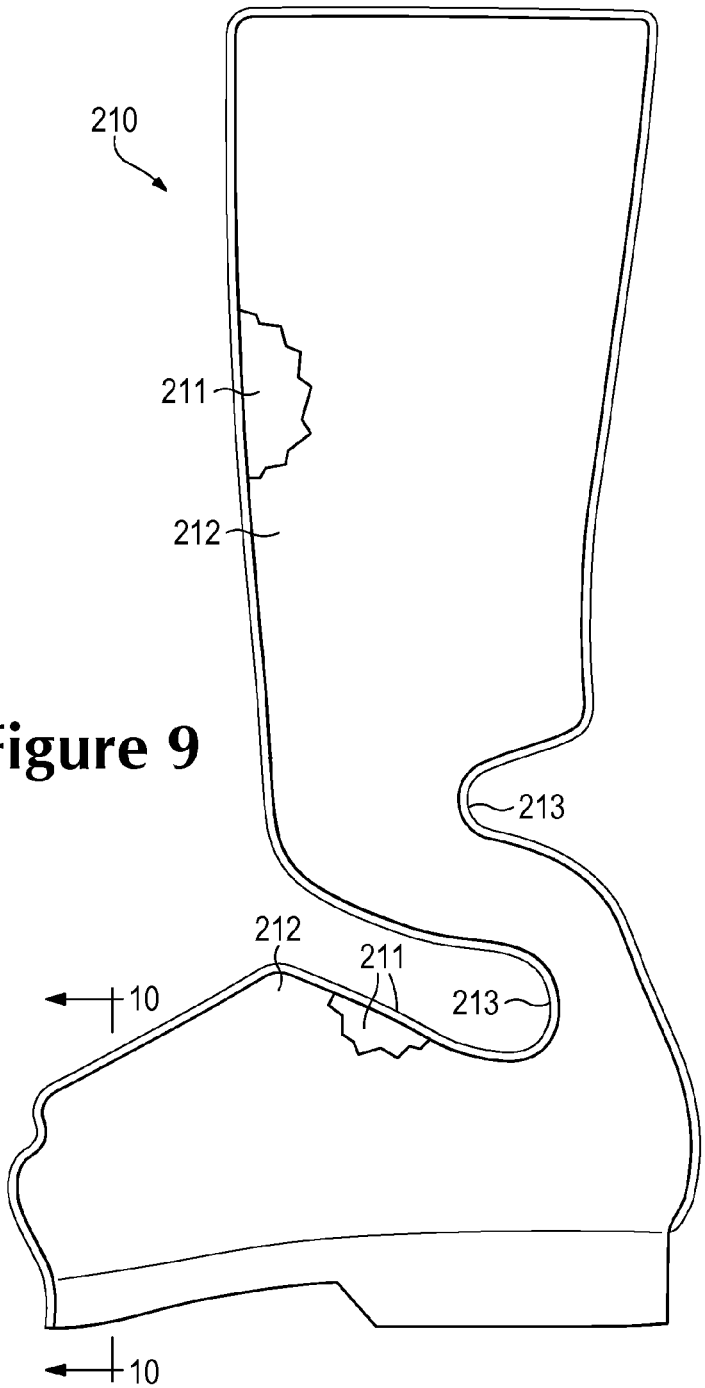
FIG. 9 is an elevational view of the plate.
Figure 10:
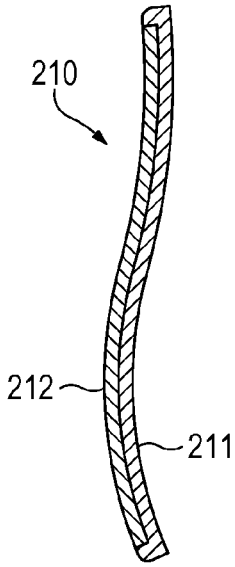
FIG. 10 is a cross-sectional view of the plate, as defined by section line 10 in FIG. 9.

Plate 210 is depicted individually in FIGS. 8-10 and provides an area of contact between a rider and a side of a motorcycle. While executing various maneuvers on a motorcycle, the rider may gain an advantage by gripping the sides of the motorcycle with the lower legs and feet. For example, aerial maneuvers (e.g., flips) that are performed during freestyle motocross competitions may benefit from the rider pressing the lower legs against the sides of the motorcycle to (a) remain properly positioned on the motorcycle and (b) assist with controlling the motion and orientation of the motorcycle while airborne. As such, plate 210 is located on medial side 105 and extends throughout a majority of a height of boot 100 in order to maximize the area of potential contact between the rider and the motorcycle. Moreover, plate 210 has a generally smooth and continuous configuration to enhance the area of contact between the rider and the motorcycle, as well as enhancing the rider's feel of the motorcycle.

Although plate 210 may have a variety of shapes, plate 210 is depicted as having a first elongate area extending vertically through leg portion 202 and second elongate area extending along medial side 105 of foot portion 201. Moreover, rearward portions of plate 210 wrap around the rearward area of upper 200 and sole structure 300 to form a portion of a rear surface of boot 100. In heel region 103, plate 210 includes a pair of indented areas 213 with relatively little width located at an interface between foot portion 201 and leg portion 202. As discussed in greater detail below, the hinged system allows leg portion 202 to rotate relative to foot portion 201 in a forward-rearward direction (i.e., between forefoot region 101 and heel region 103), with indented areas 213 facilitating this movement.

Suitable materials for back plate 211 include a variety of rigid and semi-rigid polymers that are durable and capable of withstanding multiple impacts with the motorcycle or other objects. Examples of materials that may be utilized for back plate 211 include polyethylene, polypropylene, thermoplastic polyurethane, polyether block amide, nylon, and blends of these materials. Composite materials may also be formed by incorporating glass fibers or carbon fibers into the polymer materials discussed above in order to enhance the overall strength of plate 210. In order to increase the friction properties between boot 100 and the sides of the motorcycle, overlay 212 extends over back plate 211 and forms the exterior surface of boot 100 in the area of plate 210. Whereas back plate 211 is formed from a relatively rigid or semi-rigid material to impart stiffness and protection, overlay 212 is formed from a softer material and assists with gripping the motorcycle. A suitable material for overlay 212 is a temperature-resistant rubber or a thermoplastic rubber that may be subjected to elevated temperatures in areas that contact the motorcycle. Other suitable materials include many of the polymers discussed above when utilized with a plasticizer.

Figure 1:
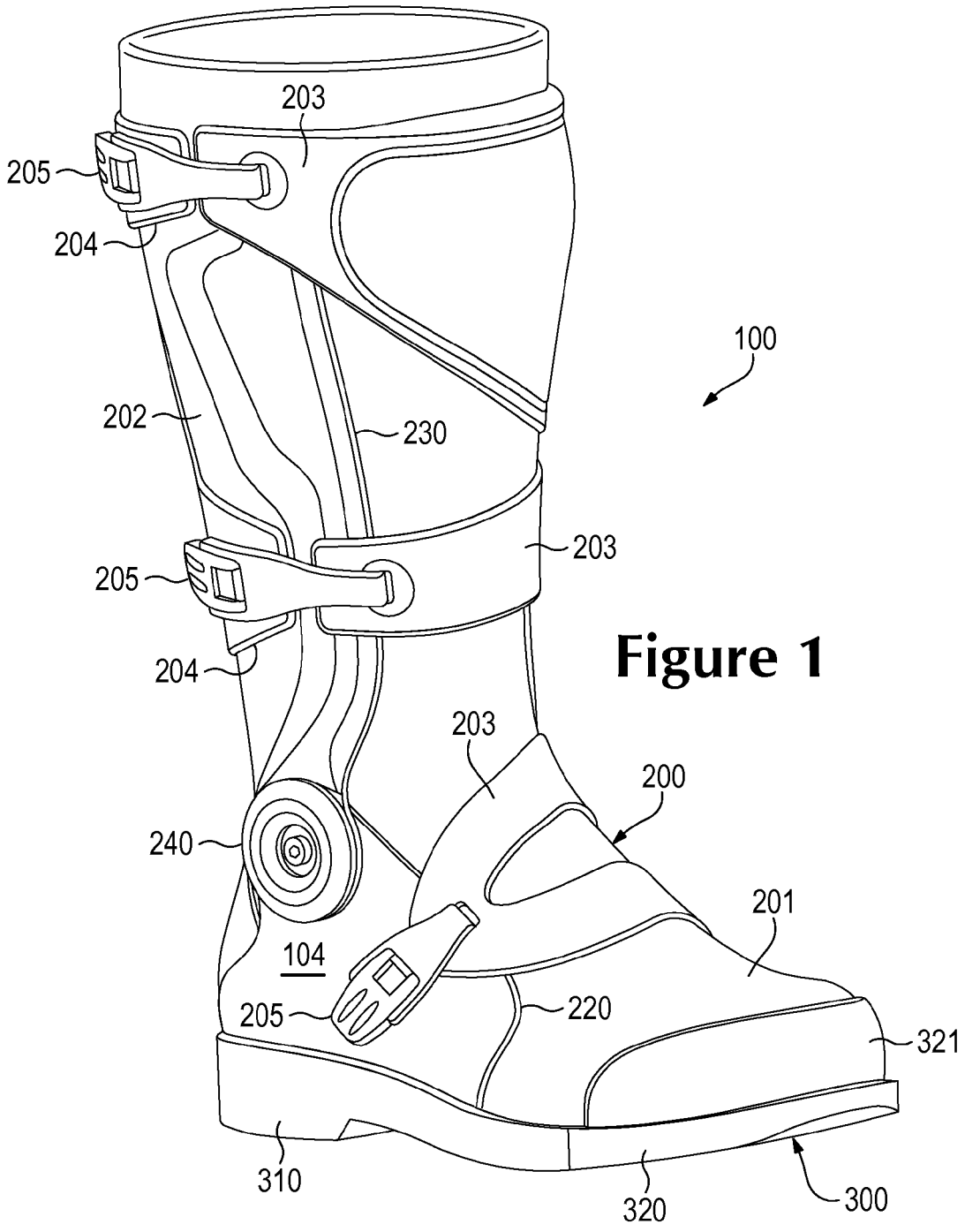
FIGS. 1 and 2 are perspective views of a boot.
Figure 2:
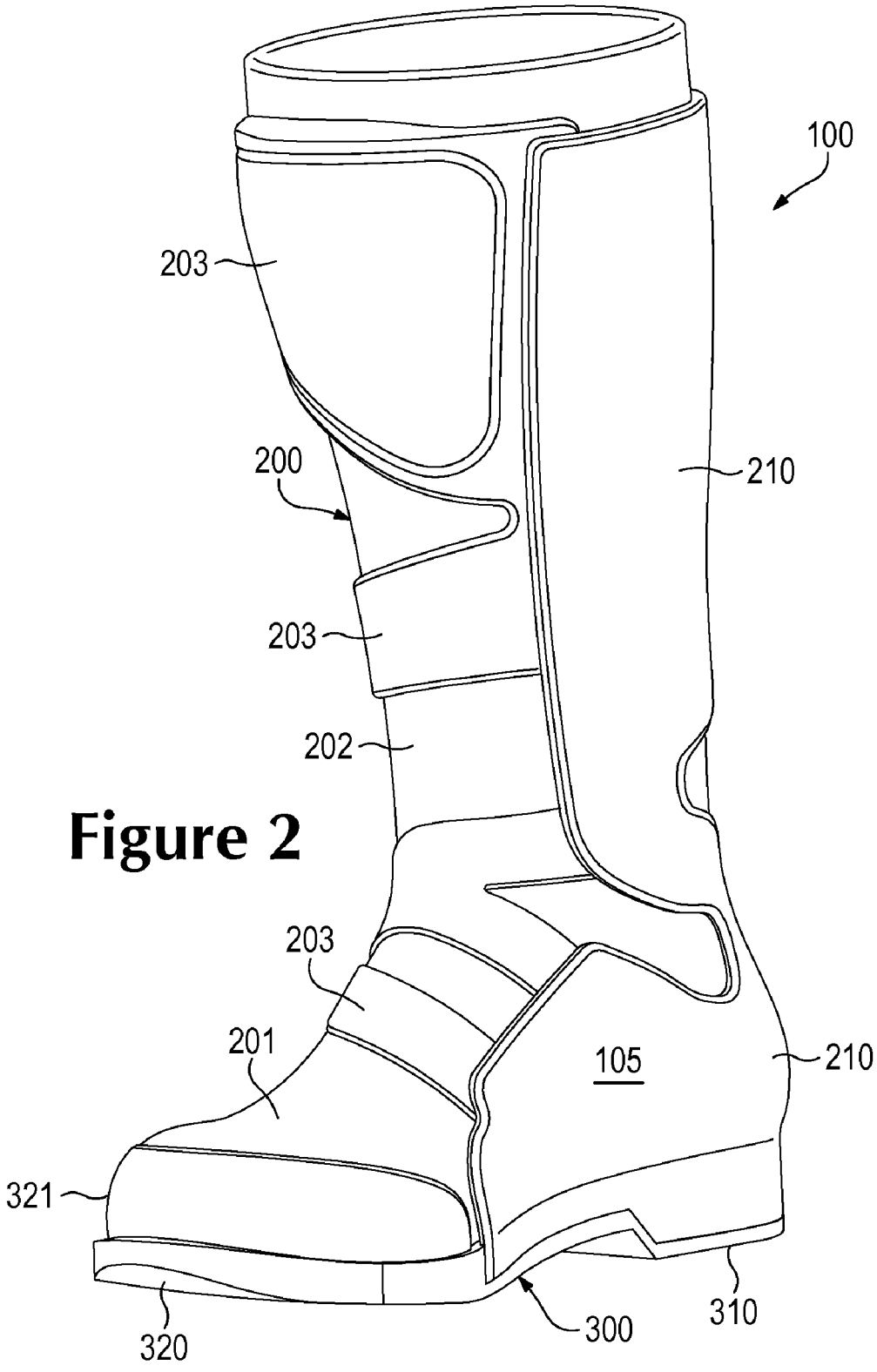
Figure 3:
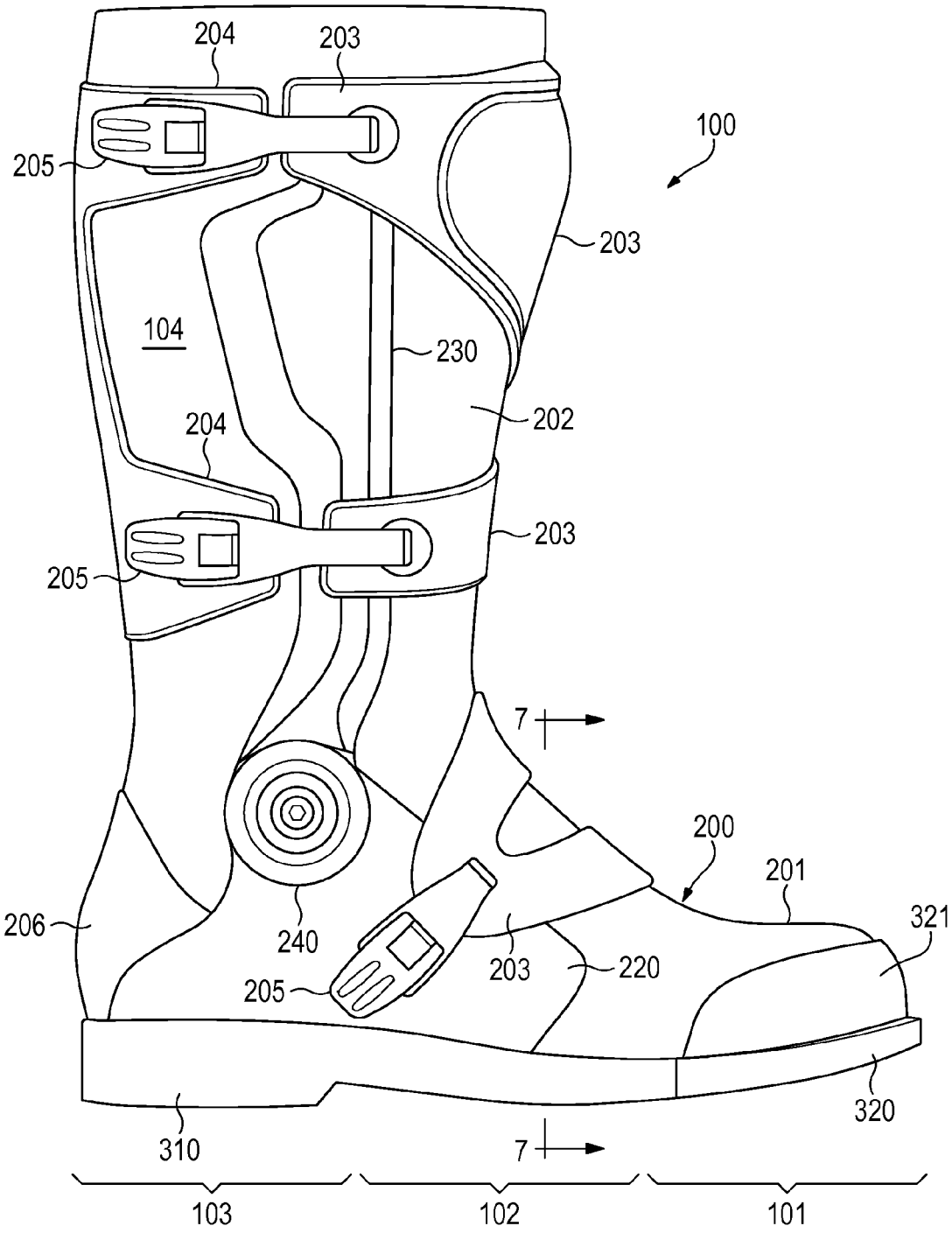
FIG. 3 is a lateral side elevational view of the boot.
Figure 4:
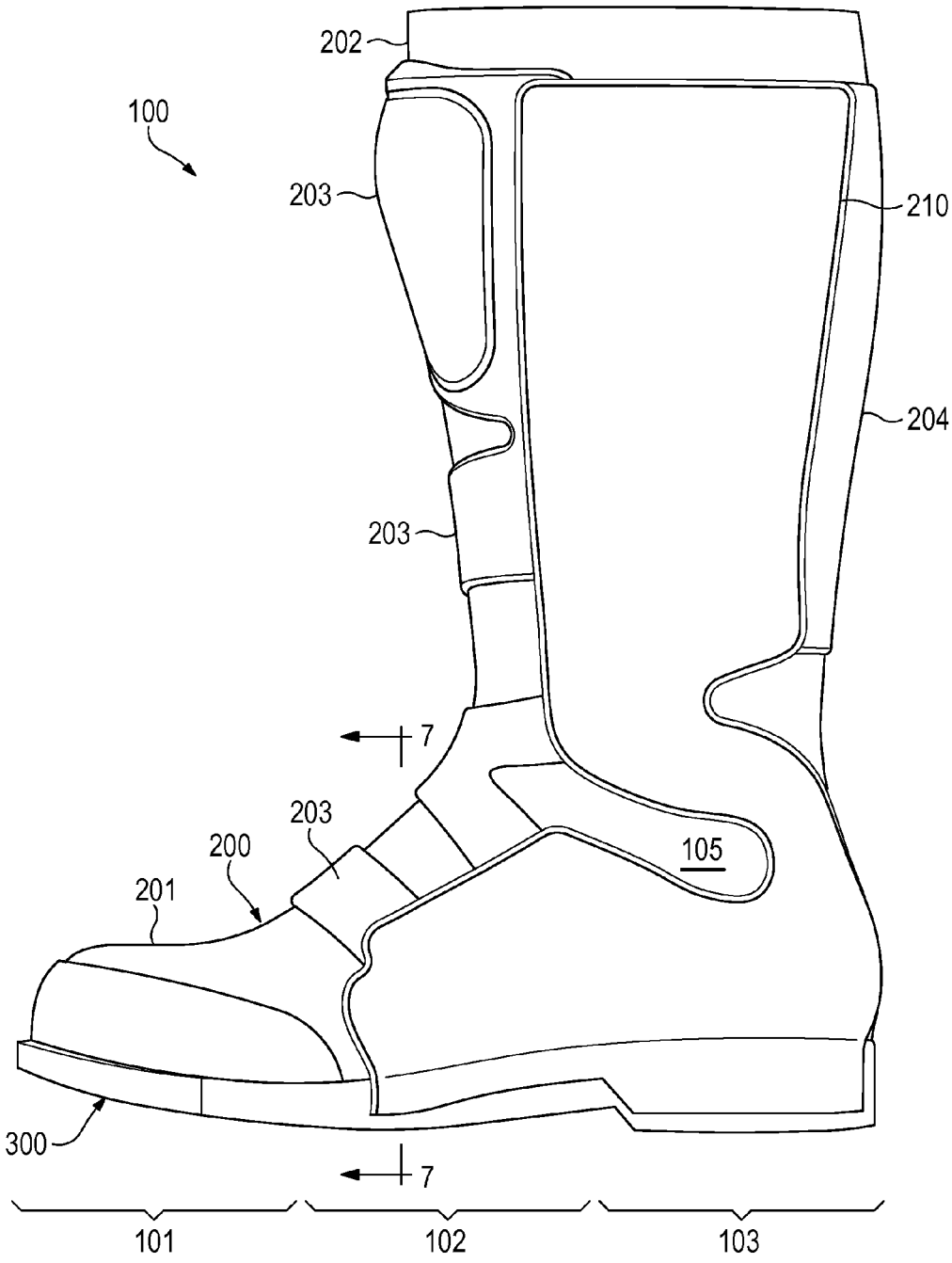
FIG. 4 is a medial side elevational view of the boot.
Figure 5:
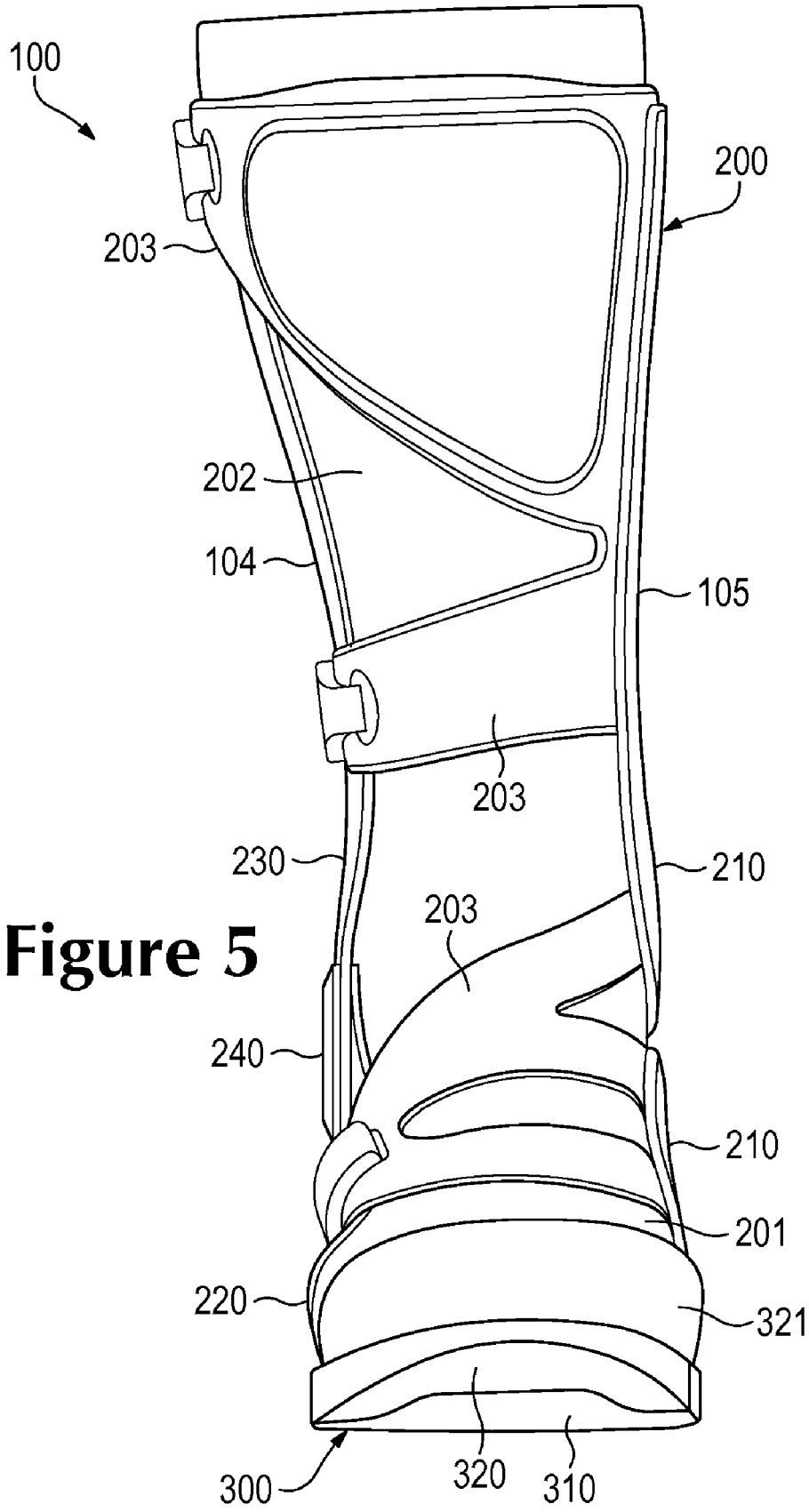
FIG. 5 is a front elevational view of the boot.
Figure 6:
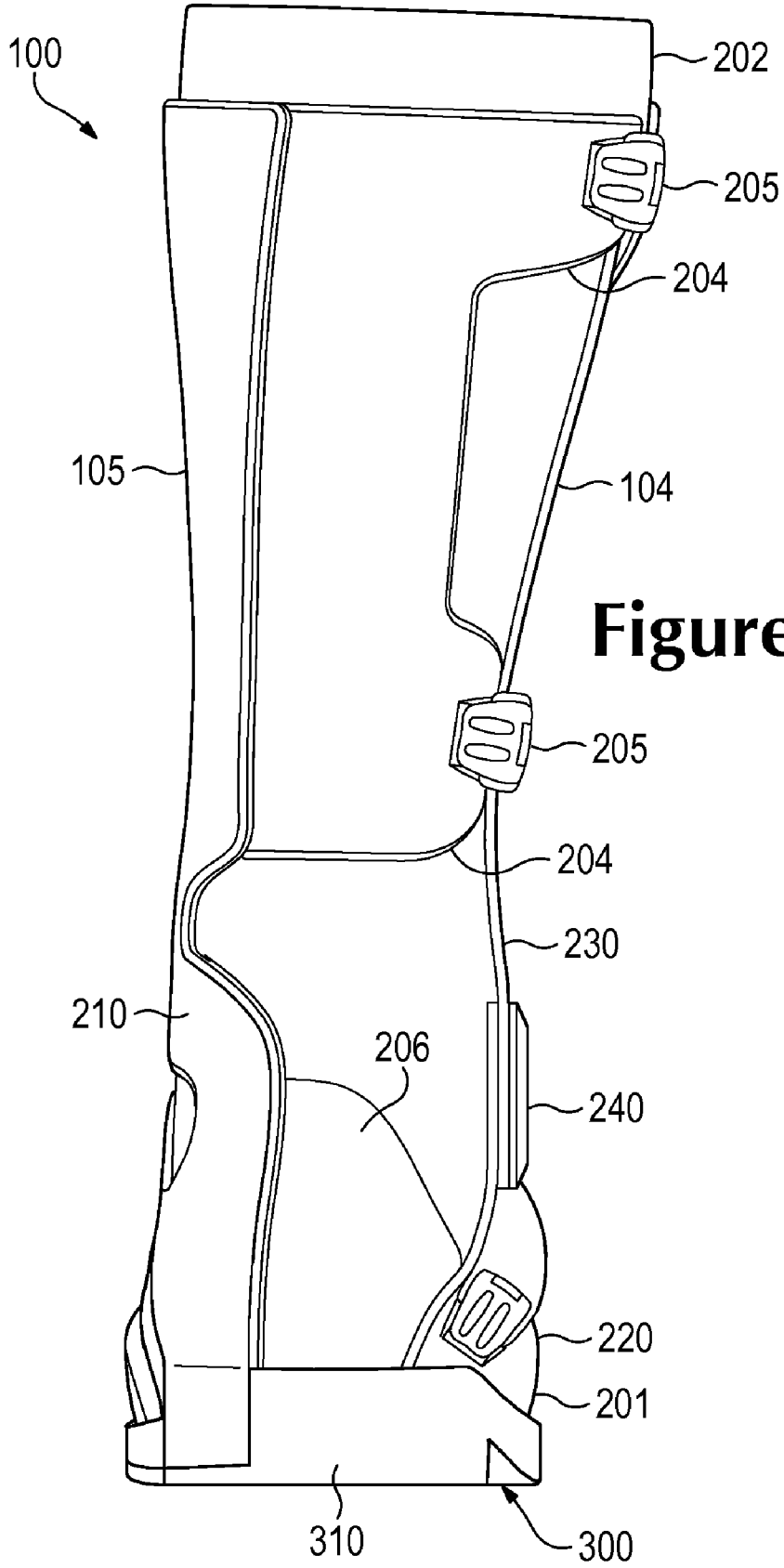
FIG. 6 is a rear elevational view of the boot.

When incorporated into boot 100, plate 210 extends throughout a majority of a height of boot 100 and also covers a majority of a width of leg portion 202, as depicted in FIG. 2, thereby maximizing the area of plate 210 and the potential area of contact between plate 210 and the motorcycle. More particularly, plate 210 extends through at least fifty percent of a height of boot 100 and covers at least fifty percent of medial side 105 in many configurations of boot 100. In further configurations of boot 100, plate 210 may extend through between fifty and one-hundred percent of the height of boot 100, and plate 210 may cover between twenty and seventy percent of medial side 105. As depicted in the various figures, however, plate 210 extends through at least ninety percent of the height of boot 100 and covers at least fifty percent of medial side 105.

Figure 7:
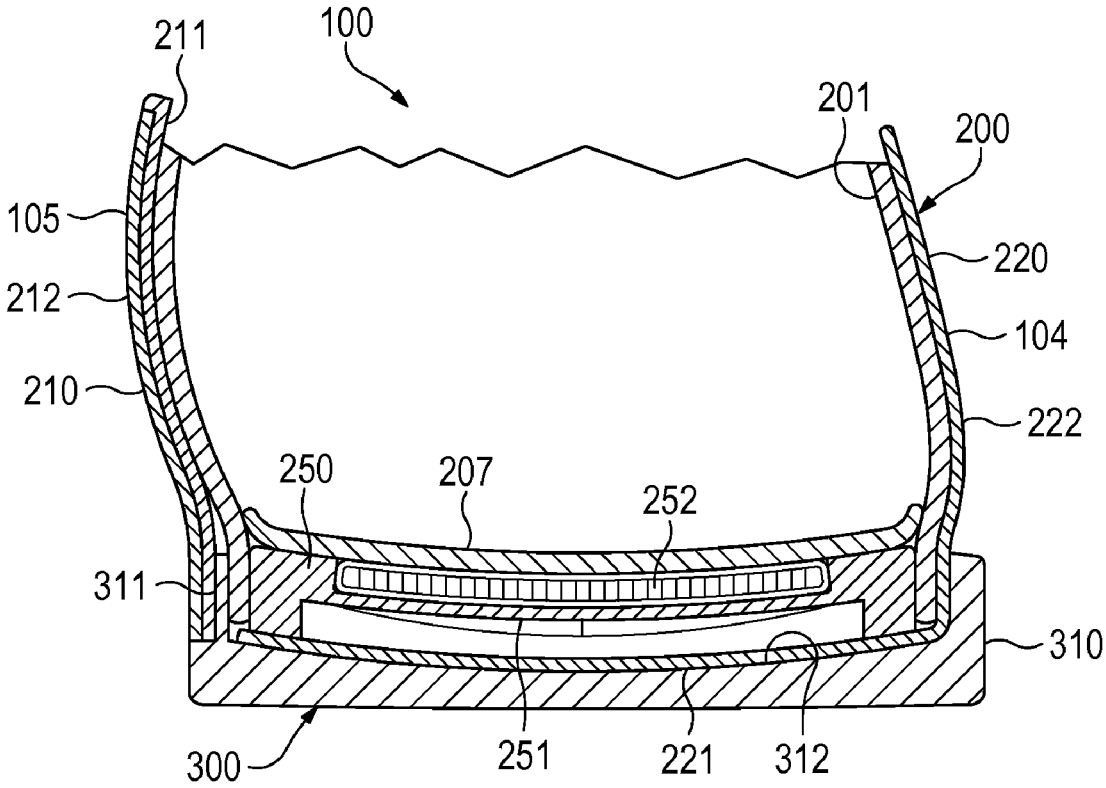
FIG. 7 is a cross-sectional view of the boot, as defined by section line 7 in FIGS. 3 and 4.
Figure 11:
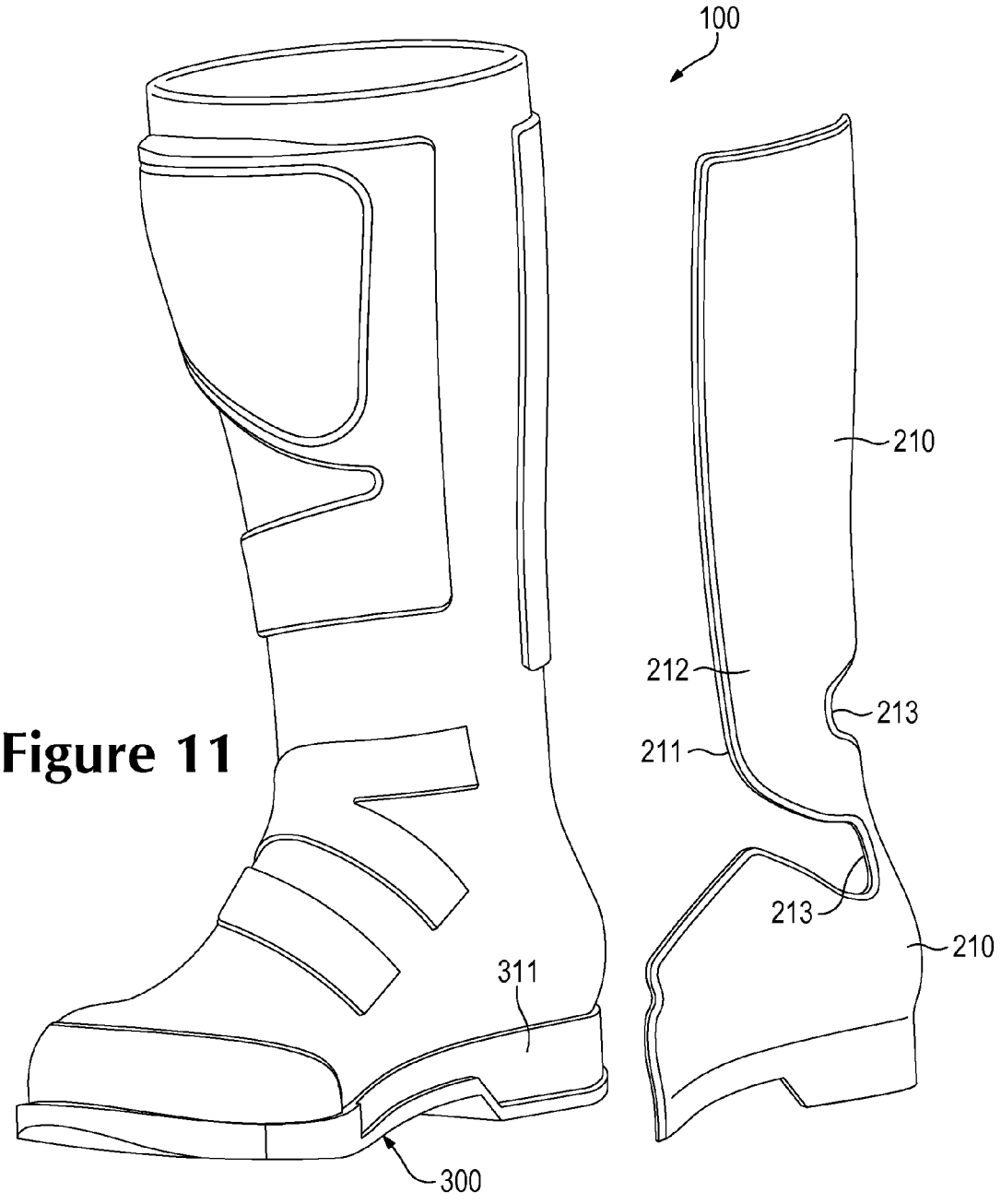
FIG. 11 is an exploded perspective view of the boot.
Figure 12:
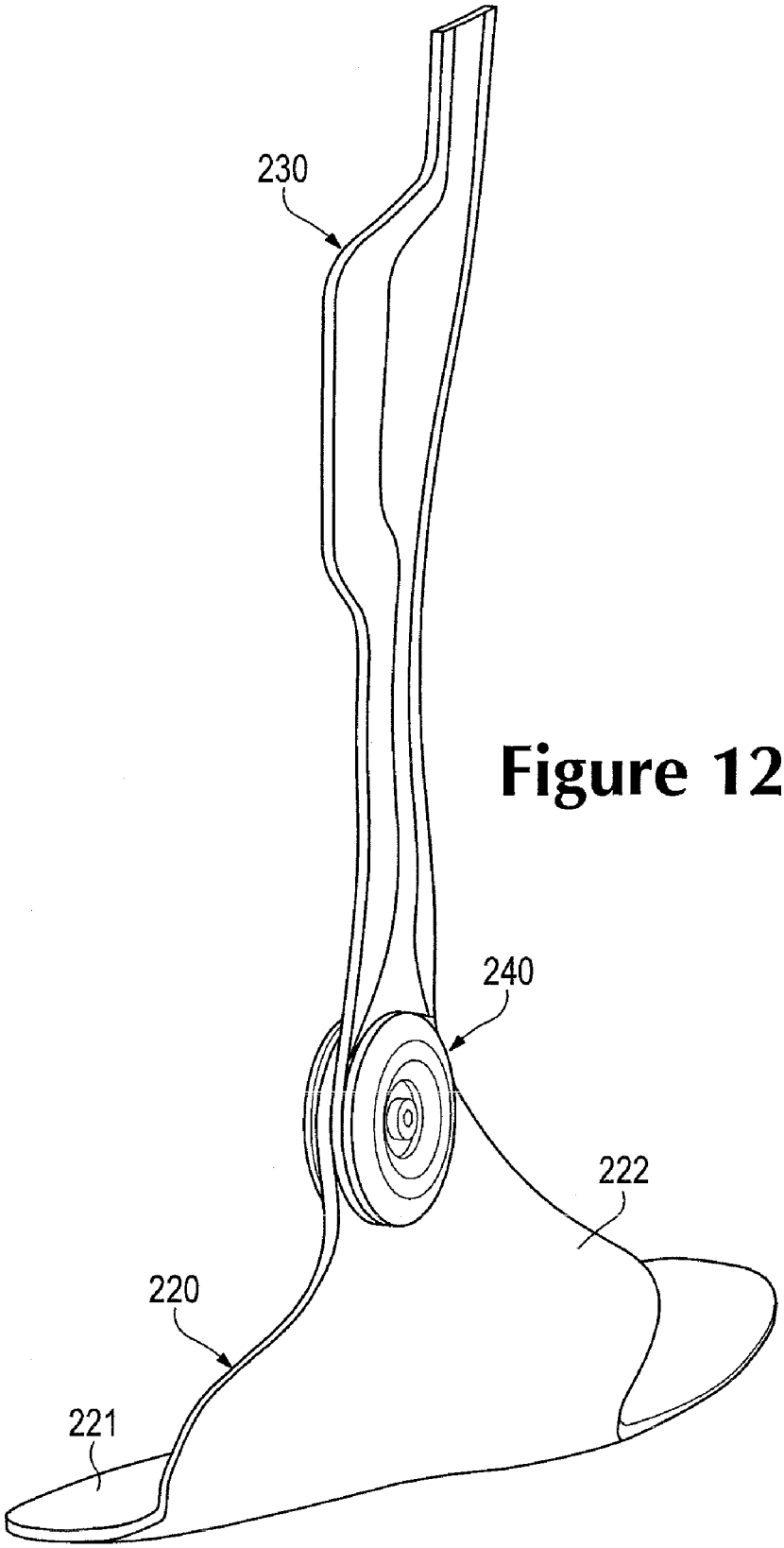
FIGS. 12 and 13 are perspective views of a hinge system of the boot.
Figure 13:
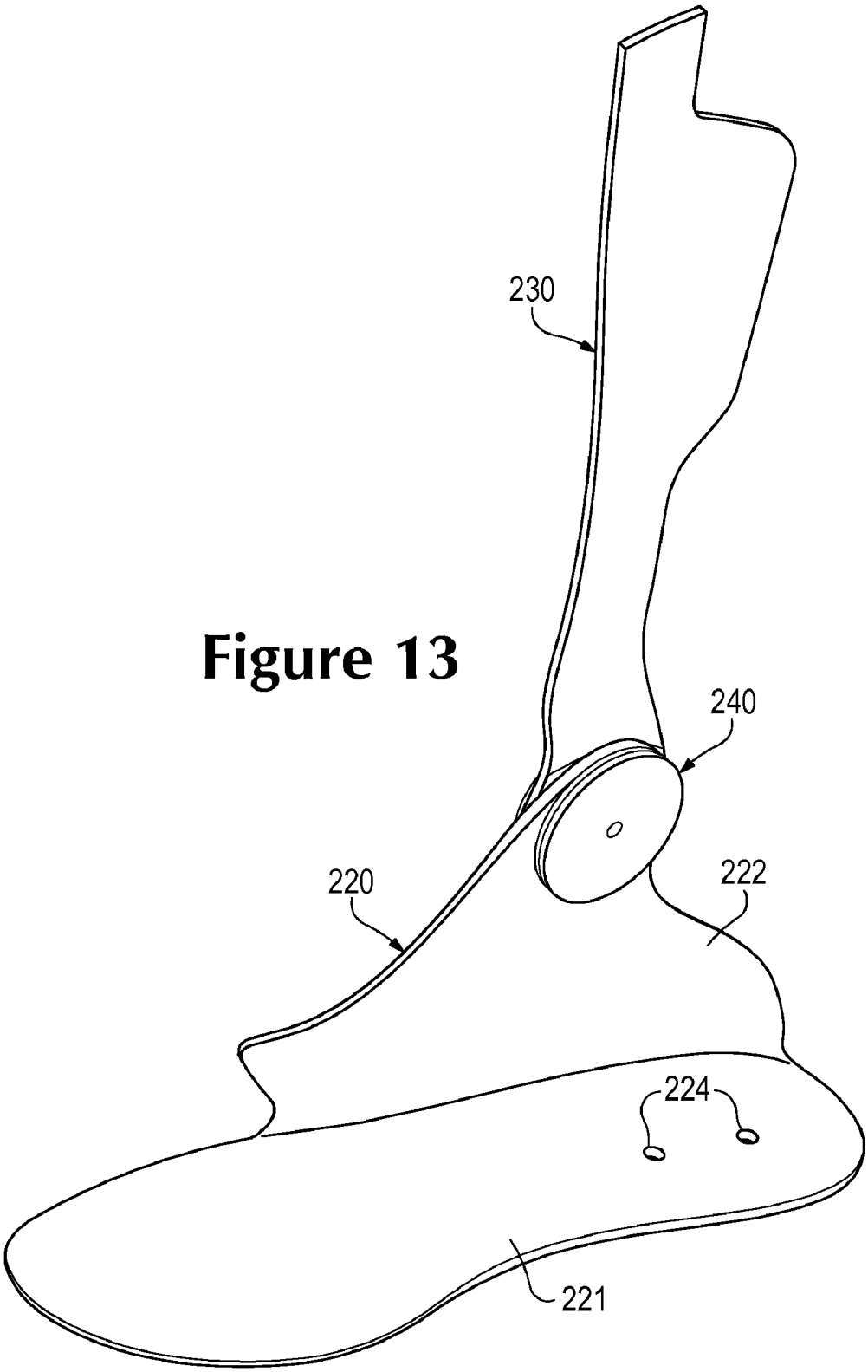
Figure 14:
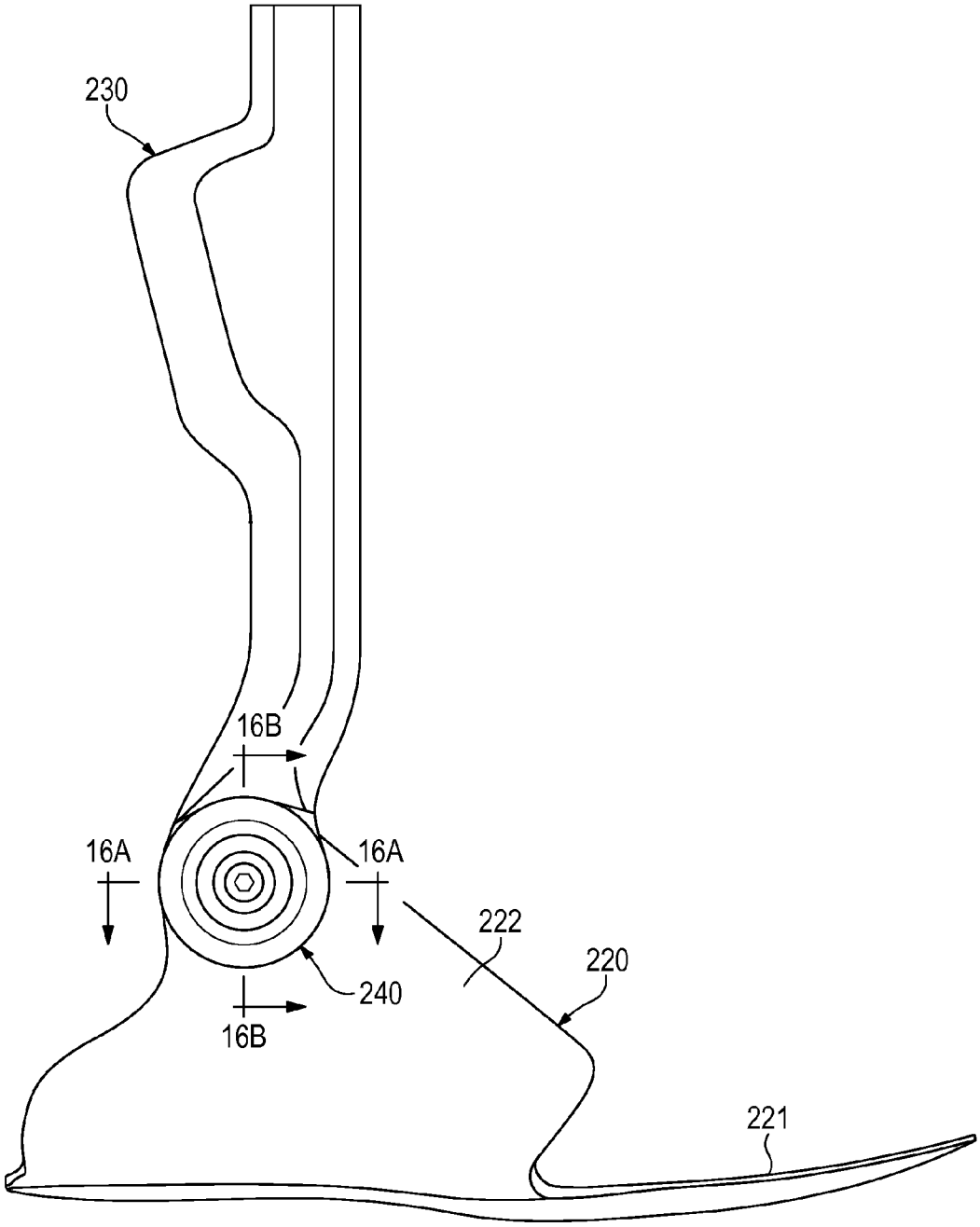
FIG. 14 is a side elevational view of the hinge system.
Figure 15:
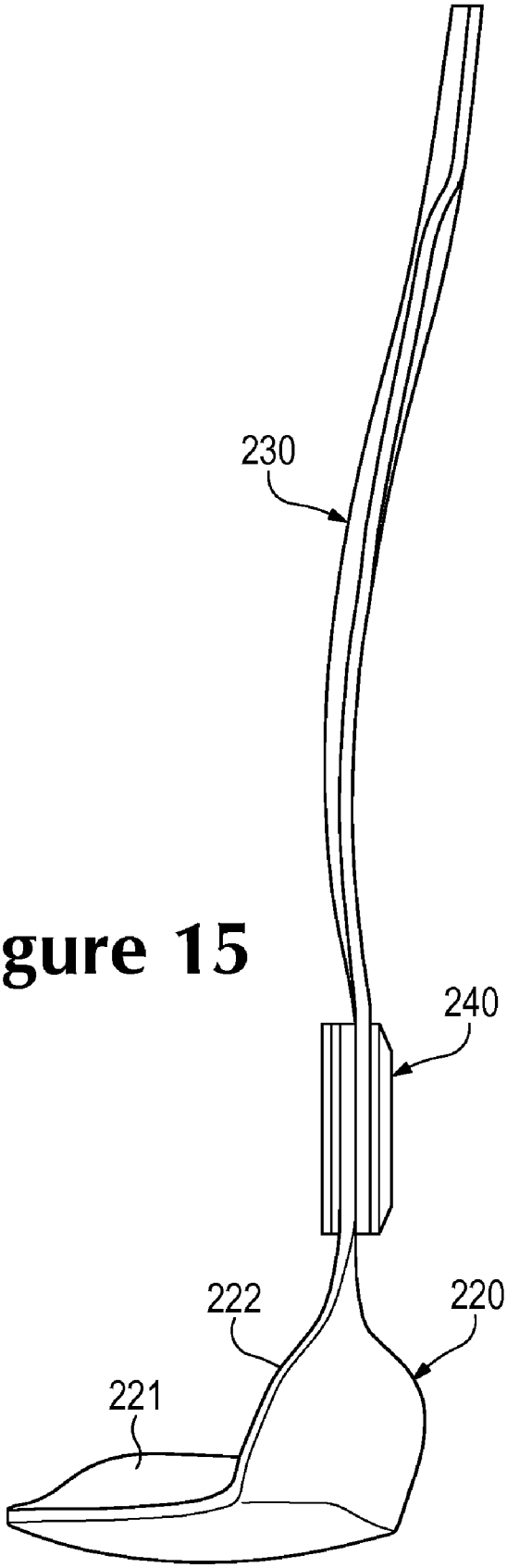
FIG. 15 is a rear elevational view of the hinge system.
Figure 16A:
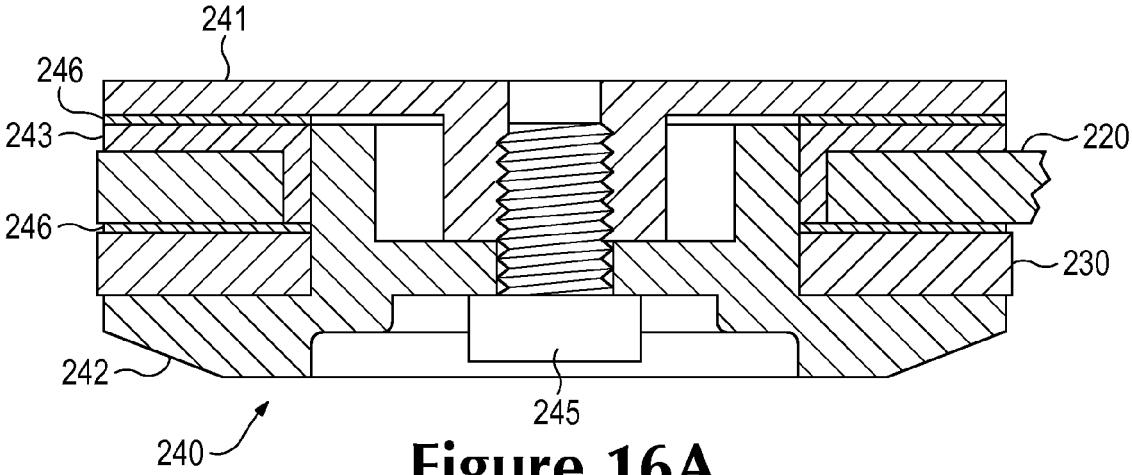
FIGS. 16A and 16B are a cross-sectional views of the hinge system, as respectively defined by section lines 16A and 16B in FIG. 14.
Figure 16B:
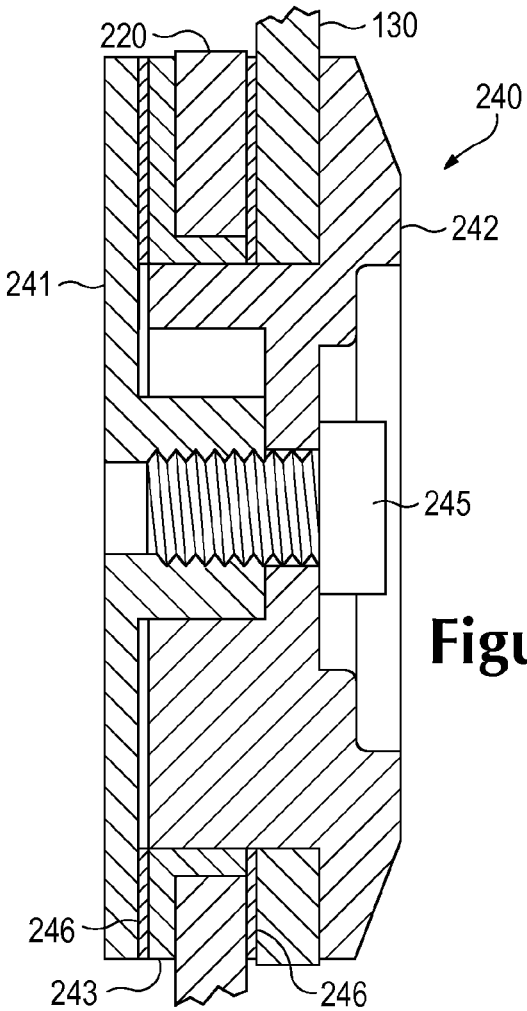

Although a majority of plate 210 is secured to and covers upper 200, a portion of plate 210 extends over sole structure 300. Referring to FIGS. 7 and 11, for example, rearward sole section 310 defines an indentation 311 that receives plate 210. That is, plate 210 extends into indentation 311 to form a flush outer surface between sole structure 300 and plate 210. Moreover, indentation 311 extends through a majority of the height of sole structure 300, and may extend through at least eighty percent of the height of sole structure 300. In this configuration, plate 310 extends to an area that is adjacent a lower surface (i.e., a ground-engaging surface) of sole structure 300 in order to further maximize the area of plate 210 and the potential area of contact between plate 210 and the motorcycle.

Overlay 212 continuously forms an exterior surface of upper 200 from leg portion 202 to indentation 311. That is, overlay has a substantially unbroken or continuous presence in the area between leg portion 202 and sole structure 300. Moreover, overlay 212 covers all of back plate 211 or covers substantially all of back plate 211 to form a continuous and relatively smooth surface that forms an area of contact between plate 210 and the motorcycle.

With regard to manufacturing, plate 210 may be formed through a variety of molding processes. For example, a sheet of thermoplastic polyurethane that forms back plate 211 may be heated and placed within a mold to form the general contours of plate 210. Following the shaping of back plate 211, overlay 212 may be added through another molding process. As another example, back plate 211 may be injection molded, and a subsequent molding step may form overlay 212. In some configurations of boot 100 where back plate 211 is formed from a thermoplastic polymer material, back plate 211 may be heated prior to securing plate 210 to the remainder of boot 100, thereby softening plate 210 and allowing plate 210 to be further shaped to conform with the contours of upper 200 and sole structure 300.

In further configurations of boot 100, plate 210 may exhibit a variety of other configurations. As an example, overlay 212 may be textured to impart greater slip-resistance between boot 100 and the sides of the motorcycle. Although plate 210 extends continuously through the height of boot 100, multiple plates or a segmented plate may also be utilized. In some configurations, overlay 212 may be absent such that the entirety of plate 210 is formed from backing plate 211, or backing plate 211 may be absent. Although plate 210 extends through more than ninety percent of a height of boot 100 and covers more than fifty percent of medial side 105, plate 210 may have lesser height or width in some configurations. Moreover, plate 210 may have a configuration that does not extend over or interface with sole structure 300. Accordingly, various aspects of plate 210 may vary.

Hinge System Configuration

The combination of chassis 220, beam 230, and hinge 240, which are depicted in FIGS. 12-16, forms the hinged system and provides underfoot support, linear and lateral support, and impact protection. Moreover, chassis 220, beam 230, and hinge 240 cooperatively restrict movement of the foot and leg about the ankle joint to prevent twisting. During participation in various motorcycle sports, the rider may place boot 100 in contact with the ground to assist with executing a turn or for gaining balance, which may subject the foot and leg to significant impact or twisting forces. During a landing following an aerial maneuver performed during freestyle motocross, the foot and leg may be subjected to impact forces. Additionally, the foot and leg may experience significant impact or twisting forces during a collision, crash, or other hazardous event. Given that beam 230, which is supported by chassis 220, extends along leg portion 202, impact forces are distributed along the length of the lower leg, instead of being concentrated at the ankle joint or foot. Also, given that hinge 240 allows beam 230 to primarily rotate in a forward-backward direction, twisting or lateral motions (i.e., inversion and eversion) are restricted. Accordingly, the hinged system imparts protection to the leg and foot, while allowing the foot and leg a relatively natural range of motion in the forward-backward direction.

Figure 17:
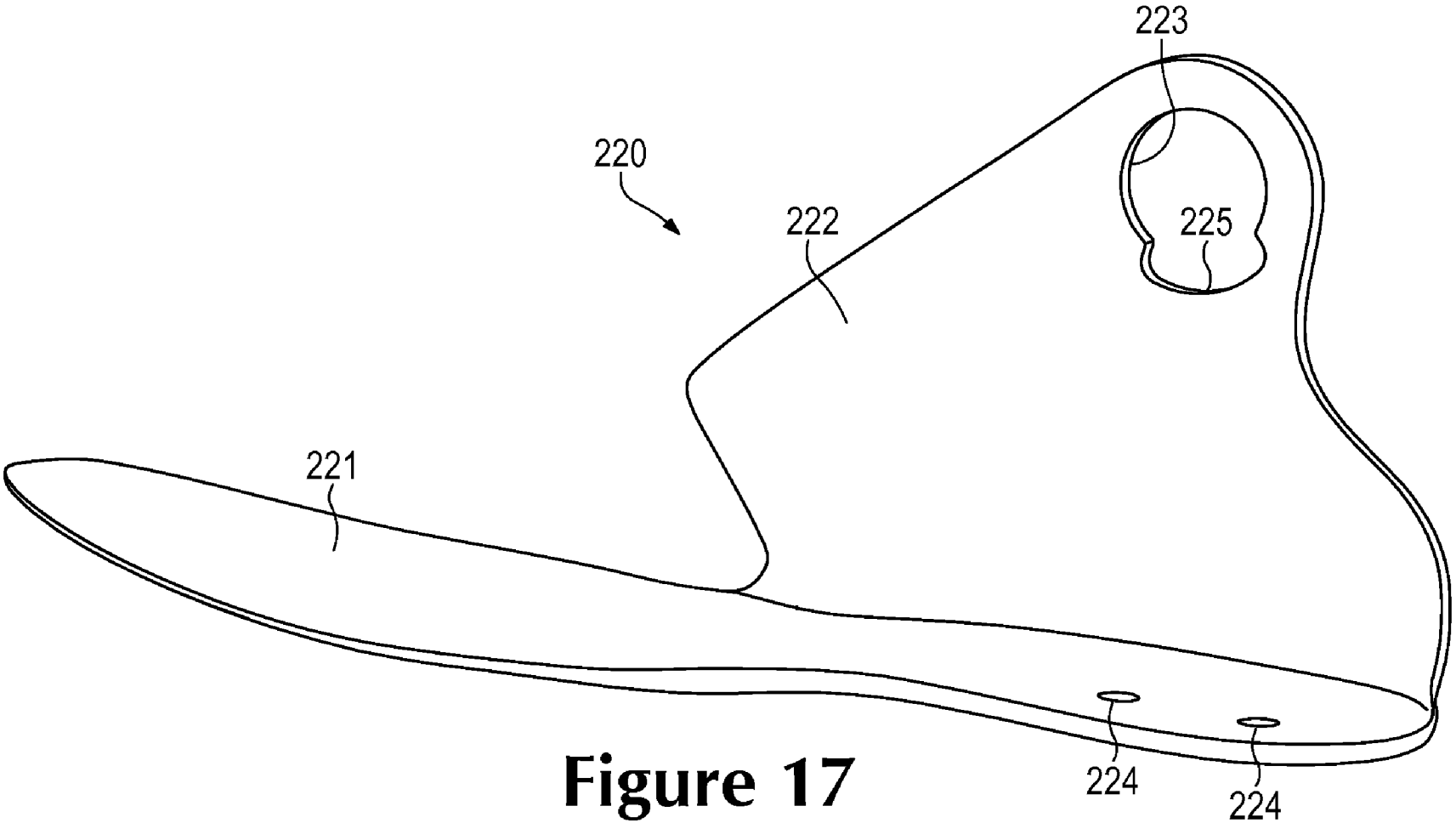
FIG. 17 is a perspective view of a chassis of the hinge system.

Chassis 220, which is depicted individually in FIG. 17, is located adjacent to foot portion 201 and includes an underfoot portion 221 and a sidefoot portion 222. Underfoot portion 221 is generally oriented horizontally and extends between a lower surface of foot portion 201 and an upper surface of sole structure 300. Although underfoot portion 221 has the general shape of a foot outline and covers a majority of the upper surface of sole structure 300, underfoot portion 221 may be limited to specific areas of boot 100 (e.g., limited to midfoot region 102 or both of regions 102 and 103). An advantage to providing underfoot portion 221 with the general shape of a foot outline and covering a majority of the upper surface of sole structure 300 is that underfoot portion 221 imparts support to the foot, thereby resisting twisting, bending, or deformation of the foot. Sidefoot portion 222 is generally oriented vertically and extends along lateral side 104 of foot portion 201. Although sidefoot portion 222 is depicted as being exposed on the exterior of boot 100, sidefoot portion 222 may also be incorporated into the material elements forming upper 200. An upper area of sidefoot portion 222 defines an aperture 223 that receives hinge 240, thereby coupling beam 230 and chassis 220 together. As an additional matter, chassis 220 may be formed of unitary (i.e., one piece) construction. That is, portions 221 and 222 are formed as a single element so that forces may be efficiently transferred among portions 221 and 222.

Figure 18:
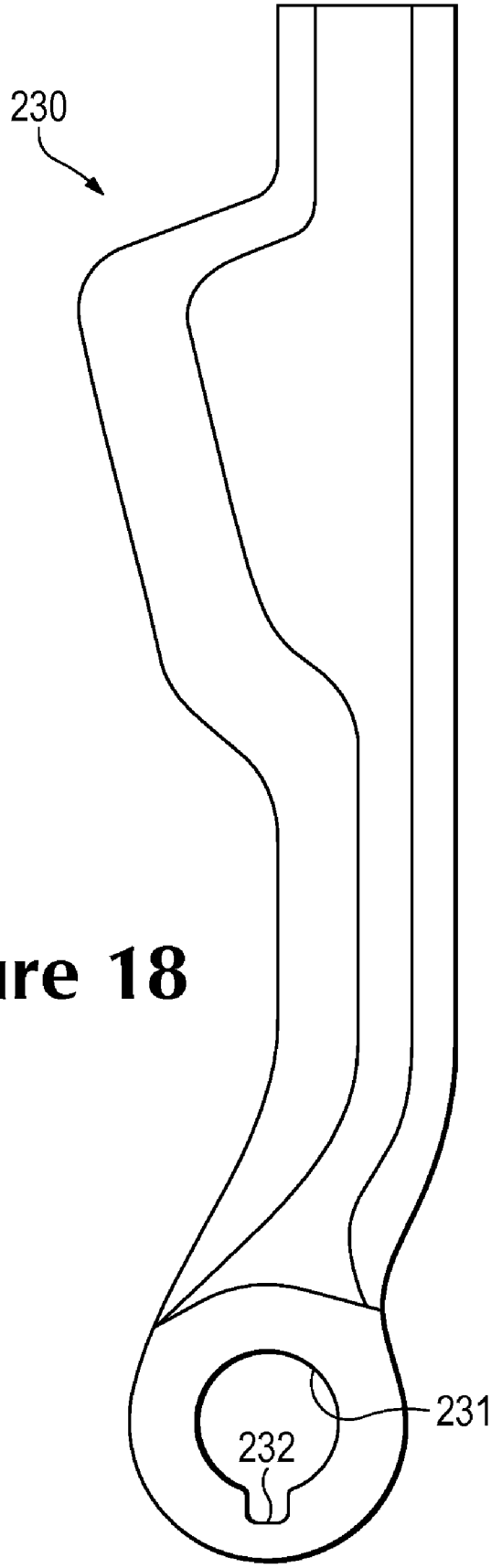
FIG. 18 is an elevational view of a beam of the hinge system.

Beam 230, which is depicted individually in FIG. 18, is located adjacent to leg portion 202 on lateral side 104. As with aperture 223 of chassis 220, beam 230 defines an aperture 231 that receives hinge 240. In general, beam 230 has an elongate configuration with a length that extends from hinge 240 to an upper area of leg portion 202. More particularly, beam 230 extends under forward flaps 203 and may be secured to forward flaps 203. In some configurations, beam 230 may also form a portion of one or both of buckles 205. Although beam 230 may have a straight and non-contoured configuration, beam 230 is depicted as having contours that match the general contours of leg portion 202, thereby allowing beam 230 to lay against the exterior surface of leg portion 202. As with chassis 220, however, beam 230 may also be incorporated into the material elements forming upper 200.

As noted above, beam 230 has a length that extends to an upper area of leg portion 202. As depicted in the figures, beam 230 extends through approximately eighty percent of a height of leg portion 202, but may extend through all of the height of leg portion 202 or at least fifty percent of the height of leg portion 202. Advantages to having beam 230 extend through at least fifty percent of the height of leg portion 202 are (a) compressive forces in leg portion 202 are effectively transferred to sole structure 300 through chassis 220 and (b) beam 230 may effectively resist twisting or lateral forces throughout most of leg portion 202.

Each of chassis 220 and beam 230 may be formed from a variety of materials, including various polymer materials, composite materials, and metals. More particularly, chassis 220 and beam 230 may be formed from polyethylene, polypropylene, thermoplastic polyurethane, polyether block amide, nylon, and blends of these materials. Composite materials may also be formed by incorporating glass fibers or carbon fibers into the polymer materials discussed above in order to enhance the overall strength of the hinged system that includes chassis 220 and beam 230. In some configurations of boot 100, chassis 220 and beam 230 may also be formed from aluminum, titanium, or steel. Although chassis 220 and beam 230 may be formed from the same materials (e.g., a composite of polyurethane and carbon fibers), chassis 220 and beam 230 may be formed from different materials (e.g., a composite and aluminum).

Figure 19A:
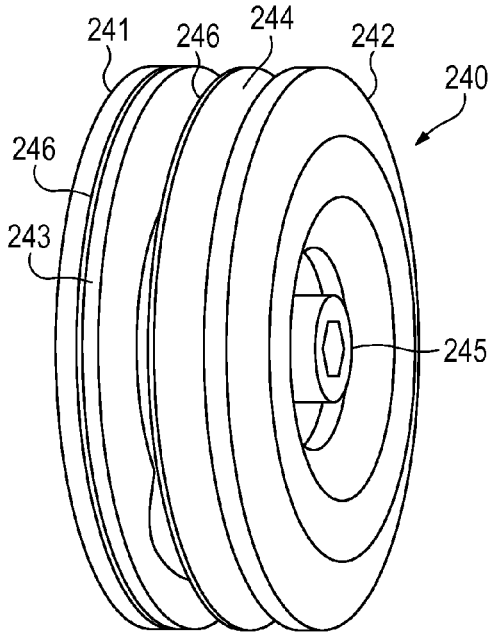
FIG. 19A is a perspective view of a hinge of the hinge system.
Figure 19B:
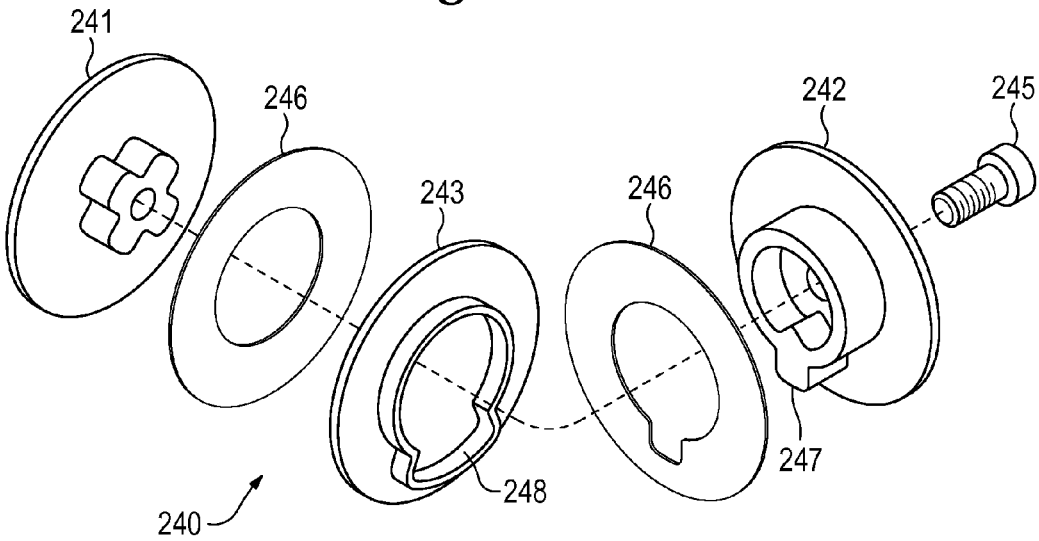
FIG. 19B is an exploded perspective view of the hinge system.
Figure 20:
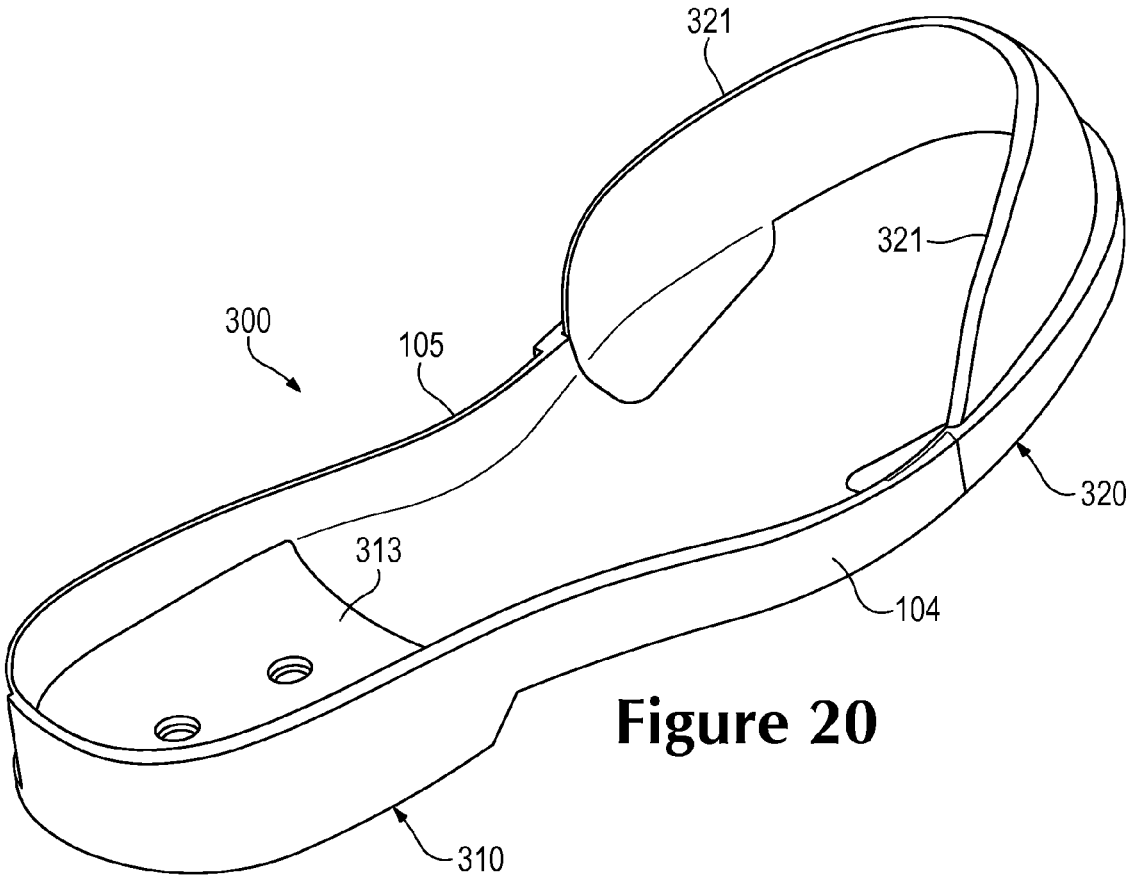
FIGS. 20 and 21 are perspective views of a sole structure of the boot.
Figure 21:
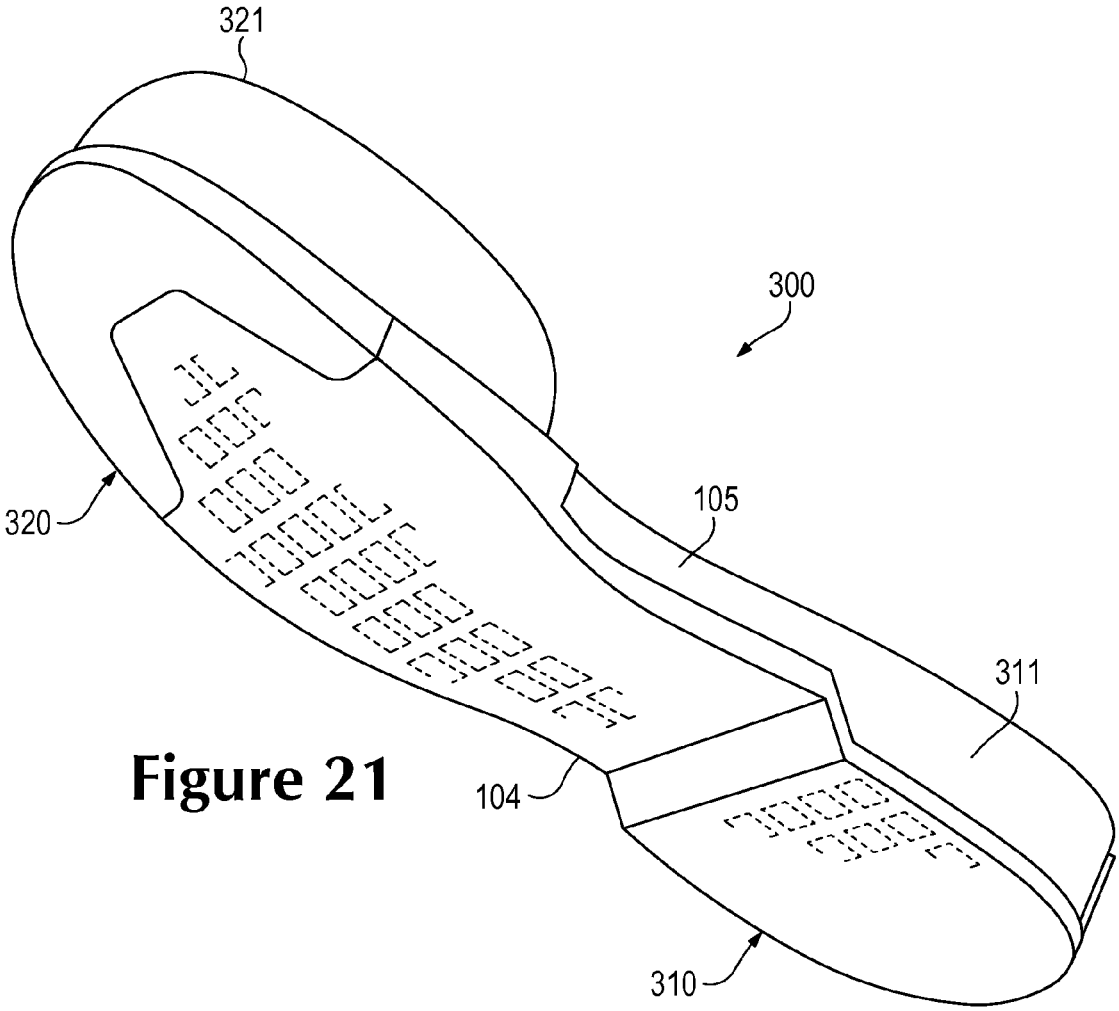

Hinge 240, which is depicted individually in FIGS. 19A and 19B, couples chassis 220 with beam 230. In general, hinge 240 has a three-part configuration that includes an inward portion 241 located in contact with upper 200, an outward portion 242 that is exposed on the exterior of upper 200 and faces away from boot 100, and an intermediate portion that is located between portions 241 and 242. In combination, portions 241-243 impart hinge 240 with a cylindrical shape having a circumferential indentation 244. That is, indentation 244 extends around the circumference of hinge 240 and may be partially formed from each of portions 241-243. When assembled with chassis 220 and beam 230, each of apertures 223 and 231 are located around and within indentation 244, and screws, nuts, or other connector 245 may be utilized to securely-join portions 241 and 242 together. Although absent in some configurations, a pair of washers 246 may also be located around indentation 244 and on opposite sides of intermediate portion 243. Suitable materials for portions 241-243 and washers 246 include a variety of polymers (e.g., nylon, polyurethane) and metals (e.g., aluminum, titanium, or steel).

Although hinge 240 allows beam 230 to primarily rotate in a forward-backward direction, the structure of hinge 240 may also limit over-rotation in the forward-backward direction. Referring to FIG. 19B, for example, outward portion 242 includes a protrusion 247 and intermediate portion 243 forms an indent 248. Also, chassis 220 forms an indent 225 in aperture 223, and beam 230 forms an indent 232 in aperture 231. When coupled, this configuration limits the degree to which beam 230 may rotate relative to chassis 220 in the forward-backward direction. Although limiting rotation may be beneficial, this structure may be absent in some configurations of boot 100 in order to allow unrestricted rotation in the forward-backward direction.

Based upon the structure of the hinged system discussed above, chassis 220, beam 230, and hinge 240 impart significant structural support to boot 100. Underfoot portion 221 of chassis 220 extends under the foot and forms a relatively rigid structure that supports the foot. Beam 230 extends along leg portion 202 and distributes impact forces along the length of the lower leg, instead concentrating impact forces at the ankle joint or foot. Moreover, beam 230 may rotate relative to chassis 220 about hinge 240, which allows leg portion 202 to rotate relative to foot portion 201 in a forward-rearward direction (i.e., between forefoot region 101 and heel region 103, or around an axis extending between sides 104 and 105), while restricting twisting motions and movement in a medial-lateral direction (i.e., in a direction extending between sides 104 and 105). Accordingly, the hinged system provides underfoot support, linear and lateral support, and impact protection.

The overall configuration of the hinged system discussed above and shown in the figures provides an example of a suitable configuration for boot 100. Various aspects of chassis 220, beam 230, and hinge 240 may, however, vary significantly. For example, chassis 220 may also be integrated with sole structure 300, such that underfoot portion 221 extends into or is molded into sole sections 310 and 320. Beam 230 may also extend over a greater surface area of leg portion 220, thereby forming a plate that offers additional impact protection to the side of the lower leg. Additionally, hinge 240 may have various other configurations that allow rotational movement between chassis 220 and beam 230.

Sole Structure Configuration

Sole structure 300, which is depicted individually in FIGS. 20-26, has the configuration of a cup sole that includes rearward sole section 310 and forward sole section 320. As discussed above, rearward sole section 310 extends from heel region 103 to at least midfoot region 102 and also defines indentation 311, which receives and joins with plate 210. In at least heel region 103, rearward sole section 310 also includes a cavity 312 that receives a polymer foam (e.g., polyurethane or ethylvinylacetate) insert 313 that compresses to attenuate forces (i.e., provides cushioning), but cavity 312 and insert 313 may be absent in some configurations of boot 100. A lower surface of rearward sole section 310 may be textured to impart traction during walking and running, as well as with various areas of a motorcycle (i.e., foot peg, brake, gear shifter). As also discussed above, forward sole section 320 is located in at least forefoot region 101 and forms flange 321, which extends onto upper 200 in forefoot region 101 to offer protection to the foot without the need for steel toe guards.

Sole sections 310 and 320 may be formed from a variety of materials. As an example, rearward sole section 310 may be formed from rubber and forward sole section 320 may be formed from thermoplastic polyurethane. As another example, each of sole sections 310 and 320 may be formed from rubber materials with different hardnesses. More particularly, forward sole section 320 may be formed from a harder, denser, or less flexible rubber material than rearward sole section 310 to impart protection to the foot in forefoot region 101, particularly in the area of flange 321. By forming rearward sole section 310 from a softer, less dense, and more flexible rubber material, rearward sole section 310 may have enhanced force attenuation properties. Additionally, this configuration may promote vibration damping, the rider's feel of a motorcycle, and foot peg attraction (i.e., the ability of boot 100 to grip foot pegs on the motorcycle). As another example of suitable materials, rearward sole section 310 may be formed from rubber, and forward sole section 320 may be formed from thermoplastic polyurethane with a greater hardness than the rubber. Although the materials forming sole sections 310 and 320 may also form the ground-engaging surface of boot 100, additional midsole elements may be secured to either or both of sole sections 310 and 320.

Figure 22:
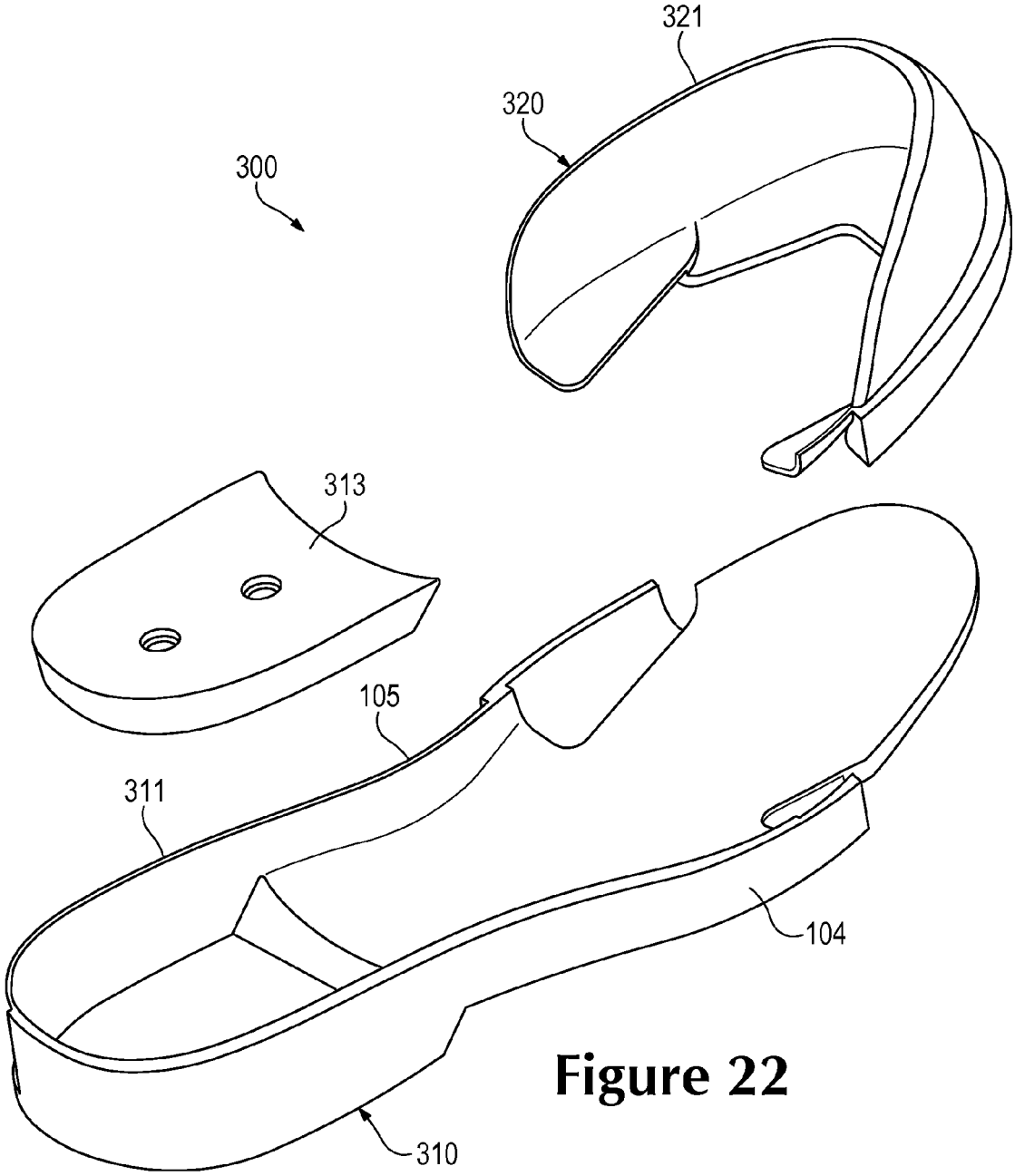
FIG. 22 is an exploded perspective view of the sole structure.
Figure 23:
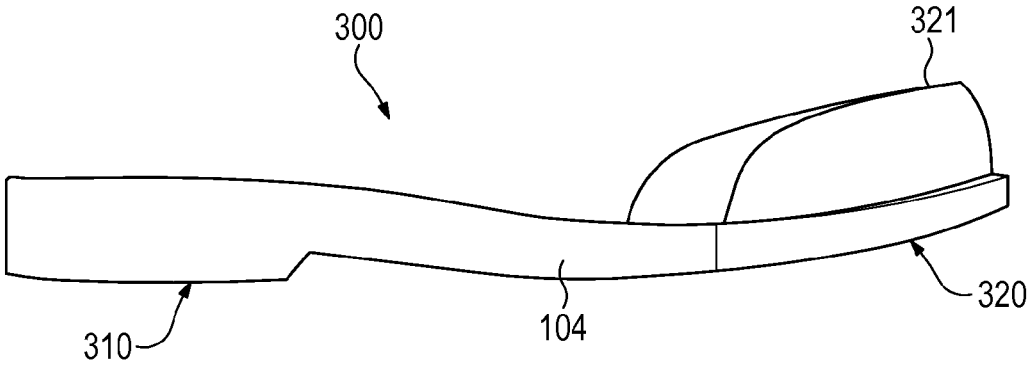
FIG. 23 is a lateral side elevational view of the sole structure.

A variety of methods may be utilized to manufacture sole structure 300. As an example, a dual-injection technique may be utilized to simultaneously form sole sections 310 and 320 within a single mold. That is, different materials may be injected into a mold to form both sole sections 310 and 320. As another example, sole sections 310 and 320 may be formed separately and joined through both of a mechanical interlock and a bonded interlock. Referring to FIG. 22, the interface between sole sections 310 and 320 have complimentary configurations that imparts a mechanical interlock between the elements. That is, rearward sole section 310 and forward sole section 320 are formed separately to have corresponding indentations, protrusions, and other contours that mate to properly join sole sections 310 and 320 together. Rearward sole section 310 forms both the upper and lower surfaces of a central area of sole structure 300, whereas forward sole section 320 forms both the upper and lower surfaces of sole structure 300 along the periphery of sole structure 300. Moreover, rearward sole section 310 forms a protrusion on each of sides 104 and 105 that mate with corresponding indentations in forward sole section 320. As utilized herein, therefore, the term "mechanical interlock" or variants thereof is defined as a joining of elements that are formed separately to include corresponding mating shapes, as with sole sections 310 and 320. To further join sole sections 310 and 320, a bonded interlock is also utilized. As utilized herein, the term "bonded interlock" or variants thereof is defined as a joining of elements with an adhesive, thermal-contact heating, or a combination of adhesive and thermal-contact heating.

Sole structure 300 is secured to upper 200 and has a configuration that extends between upper 200 and the ground. Although upper 200 may be directly secured to the upper surface of sole structure 300, underfoot portion 221 of chassis 220 extends between at least a portion of upper 200 and sole structure 300. Given that sole structure 300 has the configuration of a cup sole, sole structure 300 includes a raised periphery, which may interface and be bonded, stitched, or otherwise joined to upper 200.

Boot Manufacturing

A variety of lasting methods or other manufacturing processes may be utilized in forming boot 100. In general, upper 200 and sole structure 300 may be formed separately and subsequently joined to complete the manufacture of boot 100. More particularly, the various material elements forming upper 200 may be stitched or bonded together around a last to define the interior void in which the foot and leg are located. At this stage, the hinged system including chassis 220, beam 230, and hinge 240 may be joined with upper 200. Sole structure 300 may then be secured to upper 200 through bonding or stitching, for example. Plate 210 may then be joined to each of upper 200 and sole structure 300 (i.e., within indentation 311. Finally, a sockliner 207 (see FIG. 7) or other comfort-enhancing device may be located within upper 200 and adjacent a lower area of the void.

A further feature of upper 200 relates to a lasting board 250, as depicted in FIGS. 27-30, that is utilized in the lasting method during the assembly of upper 200. In general, lasting board 250 rests against the lower surface of a last during the assembly of upper 200. The various material elements (e.g., textiles, foam, polymer sheets and plates, leather, or synthetic leather) that are stitched or bonded together to form the void within upper 200 may be joined to the periphery of lasting board 250, as depicted in the cross-section of FIG. 7. That is, lasting board 250 may form a lower area of upper 200, which effectively supports the foot within boot 100.

Lasting board 250 includes a base element 251, a fluid-filled bladder 252, and a pair of threaded connectors 253. Base element 251 may be formed from a solid polymer material or a polymer foam material (e.g., polyurethane or ethylvinylacetate foam) that forms a periphery of lasting board 250, a portion of an upper surface of lasting board 250, and a majority of a lower surface of lasting board 250. An upper surface of lasting board 250 forms an indented area, in which bladder 252 is located. Bladder 252 may be a gas-filled and pressurized structure that incorporates an internal tensile member, as disclosed in U.S. Pat. No. 7,076,891 to Goodwin. In general, bladder 252 may extend through a majority of a length and a width of lasting board 250 to provide a compressible and comfortable surface that extends under the foot. In other configurations, bladder 252 may have a variety of other configurations, may be non-pressurized, may be filled with a liquid or gel material, or may be absent. Connectors 253 are anchored within the lower surface of base element 251 and are utilized to secure chassis 220 to lasting board 250. More particularly, bolts may extend through a pair of apertures 224 in underfoot portion 221 to interface with connectors 253. Although connectors 253 may be formed as a single element having a general dogbone shape (i.e., rounded end areas with a central connecting region), connectors 253 may also be separate threaded elements. Once chassis 220 is secured to lasting board 250, sole structure 300 may be joined.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. An article of footwear comprising:

an upper having a foot portion for receiving a foot of a wearer and a leg portion for receiving at least a portion of a leg of the wearer;

a sole structure secured to the foot portion of the upper, a medial side of the sole structure defining an indentation; and a plate that extends over the leg portion and the foot portion of the upper, and the plate extends into the indentation of the sole structure to form a flush outer surface between the sole structure and the plate, the plate having a first indented area located on a first edge of the plate at an interface between the foot portion and the leg portion, and the plate having a second indented area located on a second edge of the plate that is opposite the first edge at a position that is vertically offset from the first indented area.

2. The article of footwear recited in claim 1, wherein the indentation in the sole structure extends from a heel region to a midfoot region of the article of footwear and wherein the part of the plate extending over the leg portion has a first width and the first indented area extends through the majority of the first width.

3. The article of footwear recited in claim 1, wherein the plate includes a back plate and an overlay that extends over a surface of the back plate to form an exterior surface of the plate and the overlay is formed from a softer material than the back plate.

4. The article of footwear recited in claim 1, wherein the part of the plate extending over the leg portion has a first width and the second indented area extends through less than the majority of the first width.

5. The article of footwear recited in claim 1, wherein the first edge is a forward edge and the second edge is a rearward edge.

6. The article of footwear recited in claim 1, wherein the plate extends through at least ninety percent of a height of the article of footwear.

7. The article of footwear recited in claim 1, wherein the second indented area is disposed over the leg portion of the upper and above the first indented area.

8. The article of footwear recited in claim 1, further including a chassis located adjacent to the foot portion, a beam extending upward from the chassis and located adjacent to the leg portion, and a hinge that joins the chassis to the beam.

9. The article of footwear recited in claim 8, wherein the hinge permits rotational movement between the beam and the chassis in a forward-rearward direction, and a portion of the chassis extends between a lower surface of the foot portion and an upper surface of the sole structure.

10. The article of footwear recited in claim 1, wherein the sole structure includes (a) a rearward sole section extending from a heel region of the footwear to at least a midfoot region of the footwear, the rearward sole section forming a protrusion on each of a medial side and a lateral side, and (b) a forward sole section located in at least a forefoot region of the footwear, the forward sole section forming indentations on each of the medial side and the lateral side that mate with the protrusions of the rearward sole section, and the forward sole section being formed from a harder material than the rearward sole section.

11. An article of footwear comprising:

an upper having a foot portion for receiving a foot of a wearer and a leg portion for receiving at least a portion of a leg of the wearer;

a sole structure secured to the foot portion of the upper; and a plate that extends over the leg portion and the foot portion of the upper, the plate covering at least fifty percent of a medial side of the upper that extends from a heel region to a toe region of the upper, the plate having a first indented area located on a first edge of the plate at an interface between the foot portion and the leg portion, the plate having a second indented area located on a second edge of the plate that is opposite the first edge at a position that is vertically offset from the first indented area, and the plate including a back plate and an overlay that extends over a surface of the back plate to form an exterior surface of the plate, the overlay being formed from a softer material than the back plate.

12. The article of footwear recited in claim 11, wherein the part of the plate extending over the leg portion has a first width and the first indented area extends through the majority of the first width.

13. The article of footwear recited in claim 11, wherein a medial side of the sole structure defines an indentation, and the plate extends into the indentation.

14. The article of footwear recited in claim 13, wherein the indentation in the sole structure extends from a heel region to a midfoot region of the article of footwear.

15. The article of footwear recited in claim 11, wherein the plate extends through at least ninety percent of a height of the article of footwear.

16. An article of footwear comprising:

an upper having a foot portion for receiving a foot of a wearer and a leg portion for receiving at least a portion of a leg of the wearer;

a hinge system including:

a chassis secured to the foot portion, an underfoot portion of the chassis extending adjacent to a majority of a lower area of the foot portion, and a sidefoot portion of the chassis extending adjacent to a majority of a midfoot region of a lateral side of the foot portion, the underfoot portion and the sidefoot portion forming a unitary, one-piece construction, a beam extending adjacent to a lateral side of the leg portion and through at least seventy percent of a height of the leg portion, and a hinge securing the beam to the chassis, the hinge permitting rotational movement between the beam and the chassis in a forward-rearward direction, and the hinge restricting rotational movement between the beam and the chassis in a medial-lateral direction; and a sole structure secured to a lower area of the upper, the sole structure including a lower surface that forms a ground-engaging surface of the footwear, and the sole structure including an upper surface positioned opposite the lower surface, the underfoot portion of the chassis being located adjacent to the upper surface.

17. The article of footwear recited in claim 16, wherein the chassis defines a first aperture, the beam defines a second aperture, and the hinge extends through each of the first aperture and the second aperture.

18. The article of footwear recited in claim 17, wherein the side foot portion of the chassis tapers from a point proximate to the underfoot portion to the first aperture.

19. The article of footwear recited in claim 16, wherein the hinge has a cylindrical configuration with a circumferential indentation that receives the chassis and the beam.

20. The article of footwear recited in claim 16, wherein the underfoot portion of the chassis extends between (a) the foot portion of the upper and (b) the upper surface of the sole structure.

21. The article of footwear recited in claim 16, wherein a width of the chassis is at least twice a width of the beam.

22. The article of footwear recited in claim 16, wherein a plate is located on a medial side of the upper and extends over the leg portion and the foot portion, and the plate extends into an indentation on the medial side of the sole structure.

23. The article of footwear recited in claim 22, wherein the plate includes an overlay that continuously forms an exterior surface of the article of footwear from the leg portion of the upper to the indentation of the sole structure.

24. The article of footwear recited in claim 16, wherein the sole structure includes (a) a rearward sole section extending from a heel region of the footwear to at least a midfoot region of the footwear and (b) a forward sole section located in at least a forefoot region of the footwear, the forward sole section being formed from a harder material than the first sole section.

25. An article of footwear comprising:

an upper having a foot portion for receiving a foot of a wearer and a leg portion for receiving at least a portion of a leg of the wearer;

a hinge system including:

a chassis secured to the foot portion and defining a first aperture at an interface between the foot portion and the leg portion, the chassis having an underfoot portion extending adjacent to a majority of a lower area of the foot portion and a sidefoot portion extending adjacent to a majority of a midfoot region of a lateral side of the foot portion, the underfoot portion and the sidefoot portion forming a unitary, one-piece construction, a beam secured to the leg portion and defining a second aperture at the interface between the foot portion and the leg portion, the second aperture being aligned with the first aperture, and a hinge extending through the first aperture and the second aperture, the hinge having a cylindrical configuration with a circumferential indentation formed between two opposing walls; and a sole structure secured to a lower area of the upper.

26. The article of footwear recited in claim 25, wherein the sole structure has an upper surface and the underfoot portion is disposed over the entire upper surface of the sole structure.

27. The article of footwear recited in claim 26, further including:

a plate that extends over the leg portion and the foot portion of the upper, the plate extending into an indentation of the sole structure to form a flush outer surface between the sole structure and the plate.

28. The article of footwear recited in claim 25, wherein a portion of the chassis that defines the first aperture and a portion of the beam that defines the second aperture extends around the circumferential indentation.

29. The article of footwear recited in claim 25, wherein the beam extends through at least fifty percent of a height of the leg portion.

30. An article of footwear having an upper and a sole structure secured to the upper, the sole structure comprising:

a rearward sole section extending from a heel region of the footwear to at least a midfoot region of the footwear, the rearward sole section forming at least a portion of a ground-engaging surface of the footwear, the rearward sole section being formed from a material with a first hardness, and the rearward sole section forming a protrusion on each of a medial side and a lateral side of the sole structure; and a forward sole section located in at least a forefoot region of the footwear, the forward sole section forming at least another portion of the ground-engaging surface of the footwear, the forward sole section including a flange extending onto and joined to a lateral side and a medial side of the upper in at least the forefoot region, the forward sole section being formed from a material with a second hardness, the first hardness being less than the second hardness, the forward sole section forming indentations on each of the medial side and the lateral side of the sole structure that mate with the protrusions of the rearward sole section such that the ground-engaging surface is flush once the forward sole section and the rearward sole section are joined together.

31. The article of footwear recited in claim 30, wherein the material of the rearward sole section and the material of the forward sole section are rubber materials.

32. The article of footwear recited in claim 31, wherein the rubber materials have different densities.

33. The article of footwear recited in claim 30, wherein an upper surface of the rearward sole section defines a depression located in at least the heel region, and a polymer foam member is located within the depression.

34. The article of footwear recited in claim 30, wherein:

the upper includes a foot portion for receiving a foot of a wearer and a leg portion for receiving at least a portion of a leg of the wearer;

a medial side of the first rearward sole section defines an indentation that extends from the heel region to at least the midfoot region; and a plate located on a medial side of the upper and extending over the leg portion and the foot portion of the upper, the plate extending into the indentation of the rearward sole section to form a flush outer surface between the sole structure and the plate.

35. The article of footwear recited in claim 34, wherein the plate includes an overlay that continuously forms an exterior surface of the article of footwear from the leg portion of the upper to the indentation of the rearward sole section.

36. The article of footwear recited in claim 30, wherein the upper includes a foot portion for receiving a foot of a wearer and a leg portion for receiving at least a portion of a leg of the wearer, and the article of footwear further includes a chassis located adjacent to the foot portion, a beam extending upward from the chassis and located adjacent to the leg portion, and a hinge that joins the chassis to the beam.

37. The article of footwear recited in claim 36, wherein the chassis includes an underfoot portion extending adjacent to a majority of a lower area of the foot portion and a sidefoot portion extending adjacent to a majority of a midfoot region of a lateral side of the foot portion, the underfoot portion and the sidefoot portion forming a unitary, one-piece construction.

38. The article of footwear recited in claim 36, wherein the sole structure has an upper surface and the underfoot portion is disposed over the entire upper surface of the sole structure.

* * * * *